US009255392B2

(12) United States Patent
Miyake et al.

(10) Patent No.: US 9,255,392 B2
(45) Date of Patent: Feb. 9, 2016

(54) FLUSH TOILET DEVICE

(75) Inventors: Tsubasa Miyake, Fukuoka (JP); Konosuke Matsushita, Fukuoka (JP); Yusuke Nogoshi, Fukuoka (JP); Hirotomo Suyama, Fukuoka (JP)

(73) Assignee: TOTO LTD., Fukuoka (JP)

( * ) Notice: Subject to any disclaimer, the term of this patent is extended or adjusted under 35 U.S.C. 154(b) by 419 days.

(21) Appl. No.: 13/876,828

(22) PCT Filed: Sep. 16, 2011

(86) PCT No.: PCT/JP2011/071191

§ 371 (c)(1), (2), (4) Date: Mar. 28, 2013

(87) PCT Pub. No.: WO2012/043270

PCT Pub. Date: Apr. 5, 2012

(65) Prior Publication Data

US 2013/0185860 A1 Jul. 25, 2013

(30) Foreign Application Priority Data

| | | |
|---|---|---|
| Sep. 29, 2010 | (JP) | 2010-219690 |
| Mar. 31, 2011 | (JP) | 2011-080284 |
| Mar. 31, 2011 | (JP) | 2011-080308 |
| Mar. 31, 2011 | (JP) | 2011-080320 |
| Mar. 31, 2011 | (JP) | 2011-080511 |
| Mar. 31, 2011 | (JP) | 2011-080516 |

(51) Int. Cl.

| | |
|---|---|
| ***E03D 11/08*** | (2006.01) |
| *E03D 5/10* | (2006.01) |

(52) U.S. Cl.
CPC . *E03D 11/08* (2013.01); *E03D 5/10* (2013.01); *E03D 2201/30* (2013.01)

(58) Field of Classification Search
CPC ..... E03D 1/087; E03D 5/01; E03D 5/016; E03D 5/10; E03D 11/08; E03D 2201/30
See application file for complete search history.

(56) References Cited

U.S. PATENT DOCUMENTS

| | | | | |
|---|---|---|---|---|
| 2006/0242755 | A1* | 11/2006 | Lohss | 4/246.1 |
| 2010/0146691 | A1* | 6/2010 | Chan | 4/313 |
| 2011/0035869 | A1* | 2/2011 | Vladislav et al. | 4/431 |

FOREIGN PATENT DOCUMENTS

| | | |
|---|---|---|
| JP | 02-054029 | 2/1990 |
| JP | 04-222730 | 8/1992 |
| JP | 06-017477 | 1/1994 |
| JP | 2002-088881 A | 3/2002 |
| JP | 2010-031551 A | 2/2010 |

* cited by examiner

*Primary Examiner* — Janie Christiansen
(74) *Attorney, Agent, or Firm* — Studebaker & Brackett PC

(57) ABSTRACT

When a bowl 20*d* discharges waste with flush water after temporarily receiving the waste, before the waste is transported from at least the discharge trap conduit 40 by the flush water supplied from a flush water supply hole 30*d* as flush water supply means, the flush toilet device CSd drives a siphon pump 505*d* and then drives a return pump 506*d* before the supply of the flush water has been completed.

28 Claims, 28 Drawing Sheets

FLUSH TOILET DEVICE

TECHNICAL FIELD

The present invention relates to a flush toilet device which temporarily receives waste and discharges the waste with flush water.

BACKGROUND ART

As a flush toilet device which temporarily receives waste and discharges the waste with flush water, a flush toilet device described in the following Patent Document 1 has been proposed. As shown in FIG. 1 in the following patent document, the flush toilet device described in the following Patent Document 1 includes a bowl which has a waste receiving surface for temporarily receiving waste, flush water supply means, such as a water reservoir tank, for supplying flush water to the bowl, an inlet portion which is connected to a lower side of the bowl, a rising conduit which is formed so as to extend upward from the inlet port, a lowering conduit which is formed so as to extend downward from the end of the rising conduit, and a discharge water trap conduit which reserves water from the inlet portion to at least a part of the rising conduit as retained water when the flush toilet device is not in use and forms sealing water with at least a part of the retained water.

PRIOR ART DOCUMENT

Patent Document

Patent Document 1: Japanese Patent Application Laid-Open No. 2010-31551

SUMMARY OF THE INVENTION

Problem to be Solved by the Invention

The conventional flush toilet device described in the above Patent Document 1 was made in view of the importance in efficiently discharging waste by reducing the time during which the flush water was made to flush into the discharge water trap conduit and the time required for a siphon action, as the importance of saving water increased. Specifically, attention was paid to how to form water flow of flush water other than circling water for flushing floating waste into the retained water in the bowl and guiding the floating waste to the side of the discharge water trap while suppressing an amount of water. In addition, the new flush toilet device was proposed in order to provide a flush toilet device which is capable of reliably discharging floating waste without causing the floating waste to remain on the surface of the retained water in the bowl.

As described above, various kinds of arrangement for supplying flush water to the bowl and dealing with the flush water in the bowl have been made in order to respond to the requirement for saving water. However, regarding the retained water, which is formed in order to form sealing water, efforts have not been sufficiently made with respect to an aspect of saving water. In order to respond to a strong requirement for saving water, it is necessary to make arrangement not only in an aspect of cleaning the bowl but also in an aspect of saving water in the discharge water trap conduit.

The present invention was made in view of the above problems, and an object thereof is to provide a flush toilet device with a further enhanced water saving performance by making arrangement for dealing with retained water in the bowl and the discharge water trap conduit.

Means for Solving the Problem

In order to solve the above problem, a flush toilet device according to the present invention is a flush toilet device which temporarily receives waste and discharges the waste with flush water and includes: a bowl which includes a waste receiving surface for temporarily receiving waste; flush water supply means for supplying flush water to the bowl; a discharge water trap conduit which is connected to a lower side of the bowl, reserves water as retained water when the flush toilet device is not in use, and forms sealing water with at least a part of the retained water; and a retained water utilizing mechanism which siphons a part of the retained water from the bowl or the discharge water trap conduit as siphoned water and returns the siphoned water to the bowl portion or the discharge water trap conduit.

The retained water utilizing mechanism includes: a temporary reservoir tank which temporarily reserves the siphoned water, siphon means for siphoning a part of the retained water from the bowl or the discharge trap conduit to the temporary reservoir tank as the siphoned water, return means for returning the siphoned water which is temporarily reserved in the temporary reservoir tank to the bowl or the discharge trap conduit, and control means for controlling behaviors of the siphon means and the return means. The control means drives the siphon means before the waste is transported from at least the discharge water trap conduit with the flush water supplied from the flush water supply means when the bowl discharges the waste with the flush water after temporarily receiving the waste, and then drives the return means before the supply of the flush water from the flush water supply means is completed.

The flush toilet device according to the present invention is provided with the discharge water trap conduit, and the discharge water trap conduit is connected to the lower side of the bowl. In addition, the discharge water trap conduit reserves water as retained water when the flush toilet device is not in use, and forms sealing water with at least a part of the retained water. The sealing water formed in the bowl and the discharge water trap conduit plays a role in preventing odor from the sewer conduit from entering a toilet room and preventing pests from entering the toilet room. In order to reliably play this role, the depth of the sealing water formed in the bowl and the discharged water trap conduit is set such that the sealing water is not lost due to reasons such as evaporation of the retained water which forms the sealing water.

On the other hand, if attention is paid to the flush toilet device in use, the waste temporarily received by the bowl falls to the lower side of the bowl and is temporarily reserved at an inlet of the discharge water trap conduit. The flush water is supplied by the flush water supply means in this state, and the waste is flushed to the side of the sewer conduit through the inside of the discharge water trap conduit. Accordingly, a part of the retained water which forms the sealing water in the discharge water trap conduit is used for preventing the sealing water from being lost when the flush toilet device is not in use. On the other hand, the waste received by the bowl when the flush toilet device is in use is temporarily reserved near the inlet of the discharge water trap conduit and then flushed with the flush water. Since the retained water and the flush water supplied by the flush water supply means on the upstream side (the side of the bowl) from the vicinity of the waste contribute to the discharge of the waste, the retained water on the downstream side from the vicinity of the waste in the discharge water trap conduit does not necessarily contribute to the discharge of the waste. If attention is paid to aforementioned features in the discharge water trap conduit of the flush toilet device when the flush toilet device is in use and not in use, it is not always necessary to reserve the retained water for forming the sealing water in the same manner when the flush toilet device is in use and not in use, and there is room for making arrangement regarding how to retain water when the flush toilet device is in use and not in use.

Thus, according to the present invention, the retained water utilizing mechanism which siphons a part of the retained water as siphoned water from the bowl or the discharge water trap conduit is provided. When the bowl discharges waste, which has been temporarily received, with flush water, the retained water utilizing mechanism drives the siphon means before the waste is transported from at least the discharge water trap conduit by the flush water supplied from the flush water supply means, and then drives the return means before the supply of the flush water from the flush water supply means is completed. Since the siphon means and the return means are driven when the bowl discharges the waste with the flush water after temporarily receiving the waste as described above, it is possible to provide ordinary retained water in the discharge water trap conduit and reliably form the sealing water, sealing of which does not break, when the flush toilet device is not in use.

Since the siphon means is driven before the waste is transported from at least the discharge water trap conduit by the flush water supplied from the flush water supply means when the bowl discharges the waste, which has been temporarily received, with flush water, it is possible to siphon a part of the retained water from the discharge water trap conduit to the temporary reservoir tank and temporarily reserve the retained water as siphoned water. Since the return means is then returned before the supply of the flush water from the flush water supply means is completed, it is possible to send the siphoned water, which has been temporarily reserved in the temporary reservoir tank, back to the bowl or the discharge water trap conduit.

According to the present invention, it is possible to reliably form the sealing water, the sealing of which does not break, by providing ordinary retained water in the discharge water trap conduit when the flush toilet device is not in use as described above, and also, it is possible to siphon the retained water in a region, which does not contribute to waste discharge in the related art, in the discharge water trap conduit to the temporary reservoir tank when the flush toilet device is in use and send the retained water back to the bowl or the discharge water trap conduit at a timing at which the retained water can contribute to waste transport. Accordingly, it is possible to provide a flush toilet device with a further enhanced water saving performance by making arrangement for dealing with the retained water in the discharge water trap conduit.

In addition, in the flush toilet device according to the present invention, an amount of the retained water siphoned by the siphon means from the discharge water trap conduit to the temporary reservoir tank is preferably an amount with which the sealing water formed in the discharge water trap conduit does not break.

Since the sealing of the discharge water trap conduit does not break even if the siphon means siphons the retained water from the discharge water trap conduit to the temporary reservoir tank in this preferable mode, it is possible to reliably secure the function of the discharge water trap conduit even when the flush toilet device is in use. Accordingly, it is possible to play a role in preventing odor from the sewer conduit from entering a toilet room and preventing pests from entering the toilet room even if the retained water is siphoned from the discharge water trap conduit when the flush toilet device is in use.

In addition, the flush toilet device according to the present invention preferably includes detecting means for detecting a state immediately before use, namely before a user egests the waste in the bowl, and the control means preferably drives the siphon means in response to detection of the state immediately before use by the detecting means.

Since the siphon means is driven in response to the detection of the state immediately before use by the detecting means, the retained water is siphoned from the discharge water trap conduit during only a necessary minimum period. In addition, since the state immediately before use, namely before a user egests waste, is detected, the retained water with the waste mixed therein is not siphoned into the temporary reservoir tank. With such a configuration, it is possible to reliably avoid a situation that the waste adheres to the inside of the temporary reservoir tank and growth of bacteria is promoted in the temporary reservoir tank. Accordingly, it is possible to reliably avoid growth of bacteria in the sealing water formed in the discharge water trap conduit which communicates with the temporary reservoir tank and avoid a problem of the discharge water trap conduit being contaminated with bacteria. In addition, it is also possible to avoid the waste remaining in the sealing water in the discharge water trap conduit even if the siphoned water in the temporary reservoir tank is sent back to the bowl or the discharge water trap conduit.

The flush toilet device according to the present invention preferably includes: a toilet cover which covers the bowl; and toilet cover driving means for driving the toilet cover, the control means preferably controlling the toilet cover driving means so as to maintain a state in which the toilet cover is closed until the siphon means is driven and open the toilet cover after the siphon means is driven.

Since the state where the toilet cover is closed is maintained until the siphon means is driven in this preferable mode, it is possible to reliably prevent the waste from entering the discharge water trap conduit before the retained water in the discharge water trap conduit is siphoned into the temporary reservoir tank. In addition, it is possible to inform a user that the flush toilet device is available, by opening the toilet cover after driving the siphon means.

In the flush toilet device according to the present invention, the control means preferably drives the return means based on the supply of the flush water from the flush water supply means.

According to the present invention, the siphoned water is utilized for transporting waste and forming the sealing water after cleaning by sending the siphoned water, which has been siphoned into the temporary reservoir tank, back to the bowl or the discharge water trap conduit. It is essential to send the siphoned water back to the bowl or the discharge water trap conduit after a user completes an egesting action in order to utilize the siphoned water reserved in the temporary reservoir tank for transporting waste and forming the sealing water as described above. Accordingly, it is not preferable to send the siphoned water back to the bowl or the discharge water trap conduit during an egesting action or before egestion is completed. Thus, it is possible to reliably send the siphoned water back to the bowl or the discharge trap conduit after a user completes an egesting action by sending the siphoned water back to the bowl or the discharge water trap conduit based on the supply of the flush water from the flush water supply means and to thereby save water for the flush toilet device by utilizing the siphoned water for transporting the waste and forming the sealing water.

In addition, in the flush toilet device according to the present invention, the control means preferably drives the return means after the supply of the flush water from the flush water supply means is started.

In this preferable mode, it is possible to send the siphoned water in the temporary reservoir tank back to the bowl or the discharge water trap conduit at a delayed timing after the supply of the flush water by the flush water supply means. Accordingly, it is possible to avoid a situation that the retained water in the discharge water trap conduit is simply siphoned and simply returned to the bowl or the discharge water trap conduit and save water for the flush toilet device by reliably utilizing the siphoned water in the temporary reservoir tank for transporting the waste.

In addition, in the flush toilet device according to the present invention, the siphoned water sent back from the temporary reservoir tank to the bowl or the discharge water trap conduit is preferably configured to be supplied along a waste discharge direction in the bowl or the discharge water trap conduit.

Since the siphoned water to be sent back to the discharge water trap conduit is supplied along the waste discharge direction in the bowl or the discharge water trap conduit, it is possible to cause the flow of water to be sent back to contribute to the waste transport.

In addition, in the flush toilet device according to the present invention, the detecting means preferably includes a human body detecting sensor which detects that a user reaches a position corresponding to the state immediately before use, and the control means preferably drives the siphon means in response to detection of a user by the human detecting sensor and then drives the return means in response to a state in which the human body detecting sensor does not detect the user.

When the siphon means is driven in response to the detection of a user by the human body detecting sensor, it is assumed that the user performs an egesting action and supply of the flush water is then performed by the operation of the flush water supply means, though there is also a different case in the implementation. Even if the user reaches a position corresponding to the state immediately before use, the user leaves without using the flush toilet device in some cases. In such cases, since a state in which the siphoned water is reserved in the temporary reservoir tank continues for long time, there is a concern that the sealing water may be lost due to evaporation of the retained water forming the sealing water, and some countermeasure is required. Thus, according to this preferable mode, it is possible to reliably send back the siphoned water even if the user leaves without actually using the flush toilet device, by driving the siphon means in response to the detection of the user by the human body detecting sensor and driving the return means in response to the state in which the human body detecting sensor does not detect the user.

In addition, in the flush toilet device according to the present invention, the control means preferably drives the siphon means in response to detection of a state immediately before use by the detecting means and then drives the return means in response to elapse of a predetermined time.

When the siphon means is driven in response to the detection of a user by the human body detecting sensor, it is assumed that the user performs an egesting action and supply of the flush water is then performed by the operation of the flush water supply means, though there is also a different case in the implementation. Even if the user reaches a position corresponding to the state immediately before use, the user leaves without using the flush toilet device in some cases. In such cases, since a state in which the siphoned water is reserved in the temporary reservoir tank continues for long time, there is a concern that the sealing water may be lost due to evaporation of the retained water forming the sealing water, and some countermeasure is required. Thus, according to this preferable mode, it is possible to reliably send back the siphoned water even if the user leaves without actually using the flush toilet device, by driving the siphon means in response to the detection of the user by the human body detecting sensor and driving the return means in response to the elapse of a predetermined time.

In addition, in the flush toilet device according to the present invention, the control means preferably stops driving of the siphon means after elapse of a predetermined time after start of the driving.

By limiting the driving of the siphon means to be within the predetermined time, it is possible to reliably set the amount of water to be siphoned into the temporary reservoir tank within a predetermined amount in this preferable mode. Accordingly, it is possible to reliably prevent the retained water in the discharge water trap conduit from being unnecessarily siphoned and prevent the sealing water formed by the retained water from breaking.

In addition, in the flush toilet device according to the present invention, the retained water utilizing mechanism preferably includes sealing water adding means for supplying water separately from the retained water such that a level of the sealing water by the driving of the siphon means does not fall below a lower limit value of a level at which sealing breaks.

Since water is supplied separately from the retained water by the sealing water adding means in this preferable mode, it is possible to recover a predetermined amount of retained water even if the amount of water decreases due to evaporation of the retained water. Accordingly, it is possible to reliably avoid occurrence of the situation that the retained water is excessively siphoned and the sealing water is lost even if the drive time of the siphon means is set to a predetermined time.

In addition, the flush toilet device according to the present invention preferably includes sealing breakage preventing means for preventing a level of the sealing water formed by the retained water from falling below a level at which sealing breaks even if the siphon means is driven.

Although the siphon means is for siphoning a part of the retained water and introducing the part of the retained water into the temporary reservoir tank as described above, the amount of the retained water differs depending on a type of the flush toilet device. In order to utilize a large amount of retained water, it is necessary to adjust the retained water utilizing mechanism in accordance with the respective flush toilet devices. Particularly, when the siphon means siphons the retained water, it is necessary to avoid the sealing water being lost even for short time. In this preferable mode, it is possible to reliably secure the sealing water despite a difference in the amounts of retained water depending on models of the flush toilet devices and excessive siphoning of the siphoned water by the siphon means by providing the sealing breakage preventing means for securing the sealing water regardless of the amount of the siphoned water siphoned by the siphon means. Accordingly, it is possible to provide a flush toilet device with an enhanced water saving performance by making arrangement for dealing with the retained water in the discharge water trap conduit, in which the sealing water is not lost.

In addition, in the flush toilet device according to the present invention, the sealing breakage preventing means is preferably configured to restrict the siphon means so as not to siphon the siphoned water from the retained water if the level of the sealing water formed by the retained water reaches the lower limit level as a lower limit value of the level for avoiding the sealing breakage when the siphon means siphons the siphoned water from the retained water.

Since the siphoning of the siphoned water from the retained water by the siphon means is restricted if the retained water is siphoned up to a lower limit of the level at which sealing breakage can be avoided in this preferable mode, it is possible to reliably avoid a situation that the sealing water is lost.

In addition, in the flush toilet device according to the present invention, the siphon means is preferably configured to siphon the siphoned water from the retained water by a turbo type pump, and the sealing breakage preventing means preferably restricts the siphon means so as not to siphon the siphoned water from the retained water by forming an air gap between the turbo type pump and the retained water and causing the turbo type pump to suction the air.

By using the turbo type pump as the siphon means and utilizing a feature that water cannot be siphoned when the turbo type pump siphons the air, occurrence of the situation that the sealing water is lost is avoided in this preferable mode. By arranging the turbo type pump so as to suction the air when the level of the sealing water formed by the retained water reaches the lower limit level, the turbo type pump cannot siphon the retained water any more, and it is possible to reliably avoid sealing breakage.

In addition, in the flush toilet device according to the present invention, the retained water utilizing mechanism preferably includes a siphon conduit which connects the discharge water trap conduit to the temporary reservoir tank, the siphon conduit preferably has an insulating structure such that the siphoned water reserved in the temporary reservoir tank does not communicate with the siphoned water remaining in the siphon conduit, and the retained water utilizing mechanism is preferably configured such that the siphoned water remaining in the siphon conduit is returned to the discharge water trap conduit when the siphoning of the siphoned water from the retained water by the siphon means is stopped.

Since the retained water utilizing mechanism has the insulating structure for separating the siphoned water reserved in the temporary reservoir tank from the siphoned water remaining in the discharge water trap conduit and the siphon conduit and returns the siphoned water remaining in the siphon conduit to the discharge water trap conduit when the siphoning from the retained water is stopped, it is possible to more reliably prevent the situation that the sealing water is lost.

In addition, in the flush toilet device according to the present invention, the return means preferably returns siphoned water at a same instantaneous flow rate as an instantaneous flow rate of the siphoned water to be siphoned to the temporary reservoir tank by the siphon means such that the level of the sealing water does not fall below the lower limit value level when the siphon means continuously siphons the siphoned water into the temporary reservoir tank.

Since the siphoned water at the same instantaneous flow rate as the instantaneous flow rate of the siphoned water to be siphoned by the siphon means is returned such that the level of the sealing water does not fall below the lower limit level even when the siphon means continues siphoning from the retained water, it is possible to more reliably prevent the situation that the sealing water is lost.

In addition, the flush toilet device according to the present invention preferably includes a circulation route configured to be able to circulate the siphoned water between the bowl or the discharge water trap conduit and the temporary reservoir tank.

By providing the circulation route, the siphoned water siphoned from the retained water in the discharge water trap conduit by the siphon means is sent to the temporary reservoir tank and returned to the bowl or the discharge water trap conduit by the return means in this preferable mode. Accordingly, the siphoned water can be returned by the return means without being excessively reserved in the temporary reservoir tank even if the siphoned water is excessively supplied by the siphon means. For this reason, it is possible to exhibit the performance of the retained water utilizing mechanism without applying unnecessary load on the temporary reservoir tank.

In addition, in the flush toilet device according to the present invention, the siphon means is preferably configured by a siphon pump which siphons the siphoned water from the retained water, the return means is preferably configured by a return pump which returns the siphoned water to the bowl or the discharge water trap conduit, and the siphon pump and the return pump are preferably separately provided.

Since the siphon pump which configures the siphon means and the return pump which configures the return means are independently provided in this preferable mode, an optimal operation of the siphon pump for siphoning the siphoned water from the retained water and an optimal operation of the return pump for returning the siphoned water from the temporary reservoir tank can be combined. Accordingly, it is possible to cause the retained water utilizing mechanism for siphoning a part of the retained water from the bowl or the discharge water trap conduit and returning the siphoned water to the bowl or the discharge water trap conduit to further effectively function.

In addition, in the flush toilet device according to the present invention, the circulation route preferably includes a siphon conduit which guides the siphoned water from the retained water to the temporary reservoir tank, a return conduit which guides the siphoned water from the temporary reservoir tank to the bowl or the discharge water trap conduit, and reverse flow preventing means for acting such that water passing through the bowl or the discharge water trap conduit does not flow back through the return conduit and enter the temporary reservoir tank after the return pump is driven.

Since the return conduits which guide the siphoned water from the temporary reservoir tank to the bowl or the discharge water trap conduit are provided in this preferable mode, there is a possibility that the inside of the temporary reservoir tank may communicate with the discharge water trap conduit. If the inside of the temporary reservoir tank communicates with the discharge water trap conduit, there is a concern that the water on the side of the discharge water trap conduit may flow back into the temporary reservoir tank when the water level on the side of the discharge water trap conduit becomes higher than the water level in the temporary reservoir tank. Thus, the reverse flow of the contaminated water to the temporary reservoir tank can be reliably prevented by providing the reverse flow preventing means for preventing the water passing through the bowl or the discharge water trap conduit from flowing back through the return conduits.

In addition, in the flush toilet device according to the present invention, the discharge water trap conduit preferably includes an inlet portion which is connected to a lower side of the bowl, a rising conduit which is formed so as to extend upward from the inlet portion, and a lowering conduit which is formed so as to extend downward from an end of the rising conduit, the reverse flow preventing means is preferably configured by a first return part to which the return conduit is connected while inclining downward from a top portion thereof toward the temporary reservoir tank and a second return part to which the return conduit is connected while inclining downward from the top portion toward the bowl or the discharge water trap conduit, and is configured such that a lower end of a cross section of a flow path at the top portion is formed at a higher position than a lower end of a cross section of a flow path at a top portion of the rising conduit, and reverse flow to the temporary reservoir tank is preferably prevented by introducing air to a bent portion configured by the first return part and the second return part with the top portion interposed therebetween after the return pump is driven.

In the flush toilet device according to the present invention, a part at which the water level rises to the uppermost position corresponds to the top portion of the rising conduit. Thus, it is possible to insulate the side of a first return part from the side of a second return part by the air at the bent portion formed at the top portion of the return conduit by forming the lower end of the cross section of the flow path at the top portion of the return conduit at a higher position than the lower end of the cross section of the flow path at the top portion of the rising conduit. Accordingly, it is possible to reliably prevent the reverse flow of contaminated water to the temporary reservoir tank.

In addition, in the flush toilet device according to the present invention, the reverse flow preventing means preferably continuously drives the return pump even after water passing through the return conduit is discharged from the temporary reservoir tank and introduces the air to the bent portion by the continuous driving of the return pump.

Since the air is introduced into the bent portion by continuing the driving of the return pump even after the water passing through the return conduit from the temporary reservoir tank is discharged in this preferable mode, it is possible to configure the reverse flow preventing means without additionally providing means for introducing the air into the bent portion. Accordingly, it is possible to downsize the flush toilet device with a simple configuration.

In addition, in the flush toilet device according to the present invention, the discharge water trap conduit preferably includes an inlet portion which is connected to a lower side of the bowl, a rising conduit which is formed so as to extend upward from the inlet portion, and a lowering conduit which is formed so as to extend downward from an end of the rising conduit, and the siphon means is preferably for siphoning a part of the retained water from the rising conduit as siphoned water and siphons the siphoned water while suppressing suctioning of waste which is present in the rising conduit.

There is a concern that the siphon conduit may become blocked or the inside of the temporary reservoir tank may become contaminated if the waste in the retained water is siphoned together with the water when a part of the retained water is siphoned as the siphoned water. Thus, it is possible to prevent the blockage of the siphon conduit in advance and also suppress waste from entering the temporary reservoir tank by configuring the siphon means so as not to suction the waste which is present in the rising conduit in this preferable mode.

In addition, in the flush toilet device according to the present invention, the siphon means preferably siphons the siphoned water from the rising conduit at a higher portion than a level at which the retained water is able to form the sealing water in the discharge water trap conduit.

In the flush toilet device according to the present invention, it is also assumed that waste advances through the discharge water trap conduit from the side of the bowl and invades the rising conduit. Thus, it is possible to reliably suppress the siphoning of waste with the configuration in which the siphon means siphons the siphoned water from the retained water at a higher position than the height at which the sealing water can be formed in the rising conduit.

In addition, in the flush toilet device according to the present invention, the retained water utilizing mechanism preferably includes a siphon conduit which is connected to the inside of the discharge water trap conduit from a side so as to penetrate through a plane along which the discharge water trap conduit is bent and causes the discharge water trap conduit to communicate with the temporary reservoir tank, and the siphoned water is preferably siphoned through the siphon conduit from the discharge water trap conduit to the temporary reservoir tank.

In the flush toilet device according to the present invention, the discharge water trap conduit is formed from the upstream side to the downstream side while bent to form the sealing water. At a part where the plane along which the discharge water trap conduit is bent intersects the discharge water trap conduit, the water flowing through the discharge water trap conduit tends to be directed more strongly to the outside. Thus, the siphon conduit is configured so as not to easily siphon waste when the siphoned water is siphoned from the retained water, by providing the siphon conduit so as to be connected to the inside of the discharge water trap conduit from a side so as to penetrate through the plane along which the discharge water trap conduit is bent in this preferable mode.

In addition, the flush toilet device according to the present invention preferably includes an invasion suppressor for suppressing flush water, which is supplied to the bowl by the flush water supply means, invading the temporary reservoir tank when the flush water is discharged and flows from the discharge water trap conduit after the bowl receives waste.

Since the water to be siphoned and utilized by the siphon means corresponds to a part of the retained water, siphoning of the flush water for flushing the waste corresponds to abnormal invasion which is not originally assumed. If such abnormal invasion of the flush water is ignored, there is a concern of waste invasion and lowering of the water saving performance. In this preferable mode, the invasion of the ordinary flush water into the retained water utilizing mechanism is suppressed by providing the invasion suppressor as described above.

In addition, in the flush toilet device according to the present invention, the invasion suppressor is preferably configured by setting flow path resistance of the siphon conduit from the discharge water trap conduit to the temporary reservoir tank to be higher than flow path resistance of the discharge water trap conduit.

With such a simple configuration in which the flow path resistance of the siphon conduit is set to be higher than the flow path resistance of the discharge water trap conduit, it is possible to suppress the abnormal invasion of the ordinary flush water into the siphon conduit in this preferable mode.

In addition, in the flush toilet device according to the present invention, the discharge water trap conduit preferably includes an inlet portion which is connected to a lower side of the bowl, a rising conduit which is formed so as to extend upward from the inlet portion, and a lowering conduit which is formed so as to extend downward form an end of the rising conduit, and a lower end of a cross section of a flow path at a top portion of the siphon conduit is preferably formed at a higher position than a lower end of a cross section of a flow path at a top portion of the rising conduit.

In this preferable mode, since the lower end of the cross section of the flow path at the top portion of the siphon conduit is formed at a higher position than the lower end of the cross section of the flow path at the top portion of the rising conduit of the discharge water trap conduit, it is possible to reliably suppress the flush water flowing into the temporary reservoir tank even if the ordinary flush water is siphoned into the siphon conduit.

In addition, in the flush toilet device according to the present invention, a bent portion is preferably formed by a first siphon part and a second siphon part with the top portion interposed therebetween in the siphon conduit.

In this preferable mode, it is possible to further enhance the flow path resistance and reliably suppress the flush water flowing into the temporary reservoir tank by forming the bent portion at the top portion.

In addition, appropriate combinations of the aforementioned respective components can be included in the scope of the present invention to be protected by the patent by the present patent application.

Effect of the Invention

According to the present invention, it is possible to provide a flush toilet device with a further enhanced water saving performance by making arrangement for dealing with retained water in the discharge water trap conduit.

MODE FOR CARRYING OUT THE INVENTION

Figure 1:
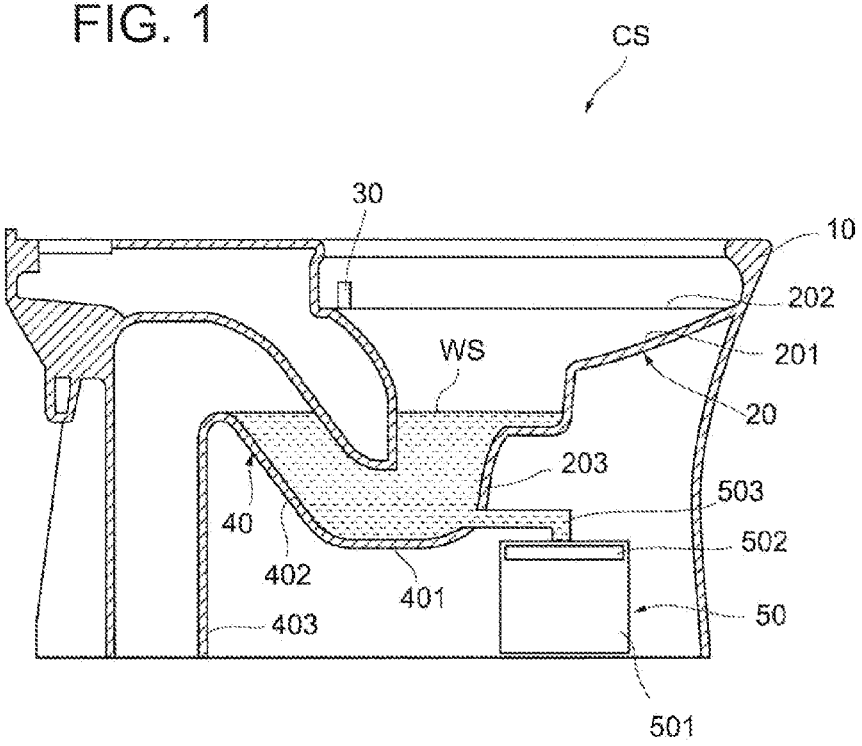
FIG. 1 is a cross-sectional view schematically illustrating a flush toilet device according to a first embodiment of the present invention.

Hereinafter, a description will be given of a flush toilet device according to embodiments of the present invention with reference to accompanying drawings. For the purpose of easy understanding of the description, the same reference numerals will be applied to the same components in the respective drawings, and a repeated description will be omitted.

A flush toilet device according to a first embodiment of the present invention will be described with reference to FIG. 1. FIG. 1 is a cross-sectional view schematically illustrating a flush toilet device CS according to the first embodiment of the present invention. A toilet bowl main body 10 in the flush toilet device CS is mainly depicted in FIG. 1, and descriptions of a toilet seat, a toilet cover, a water supply valve for flush water, a remote controller, and an operation panel thereof are omitted.

As shown in FIG. 1, the toilet bowl main body 10 is a flush toilet bowl which temporarily receives waste and discharges the waste with flush water and includes a bowl 20, a discharge water trap conduit 40, and a pump 50. The bowl 20 includes a waste receiving surface 201 which is a part of the toilet bowl main body 10 and temporarily receives waste, a rim portion 202 which causes flush water to flush to the waste receiving surface 201, and a bowl outlet portion 203 which flushes waste to the discharge water trap conduit 40. The rim portion 202 is formed at an upper peripheral edge portion of the waste receiving surface 201. A flush water supply hole 30 faces the rim portion 202. The bowl outlet portion 203 is formed below the waste receiving surface 201.

The discharge water trap conduit 40 is a part which receives waste and flush water from the bowl 20 and flushes the waste and the flush water in a direction of a sewer conduit. The discharge water trap conduit 40 includes an inlet portion 401, a rising conduit 402, and a lowering conduit 403. The inlet portion 401 is a part which is connected to the bowl outlet portion 203 formed below the waste receiving surface 201 of the bowl 20. The inlet portion 401 receives waste and flush water from the bowl outlet portion 203 and flushes the waste and flush water into the rising conduit 402.

The rising conduit 402 is a part which is formed on a side further downstream than the inlet portion 401 and formed so as to extend upward from the inlet portion 401. Therefore, the bowl outlet portion 203, the inlet portion 401, and the rising conduit 402 are connected to each other and form a U-shaped conduit as a whole.

The lowering conduit 403 is a part formed on a side further downstream than the rising conduit 402 and formed so as to extend downward from the end portion of the rising conduit 402 on the downstream side. Therefore, retained water WS retained in the U-shaped conduit formed by the bowl outlet portion 203, the inlet portion 401, and the rising conduit 402 can be retained up to a connection part between the rising conduit 402 and the lowering conduit 403. As shown in FIG. 1, water from the inlet portion 401 to at least a part of the rising conduit 402 is reserved as retained water WS when the flush toilet device CS is not in use, and sealing water is formed with at least a part of the retained water WS.

Accordingly, the pump 50 is for further exhibiting a water saving function by siphoning and sending back a part of the retained water WS retained in the U-shaped conduit formed by the bowl outlet portion 203, the inlet portion 401, and the rising conduit 402. The pump 50 includes a temporary reservoir tank 501, a piston 502, and a temporary reservoir flow path 503.

The temporary reservoir tank 501 is a tank for siphoning and reserving a part of the retained water WS. The piston 502 is provided inside the temporary reservoir tank 501. The piston 502 is configured to freely advance and retreat in a vertical direction in contact with an inner wall of the temporary reservoir tank 501. The temporary reservoir tank 501 is connected to a part, at which the bowl outlet portion 203 and the inlet portion 401 are formed, by the temporary reservoir flow path 503.

The piston 502 is brought into a stand-by state at an uppermost position as shown in FIG. 1 when the flush toilet device is not in use. As will be described later, the piston 502 can siphon the retained water WS into the temporary reservoir tank 501 by lowering from the state shown in FIG. 1. In addition, the piston 502 can send the siphoned water back to the bowl outlet portion 203 and the inlet portion 401 by lowering from the state shown in FIG. 1 and then rising.

Figure 2:
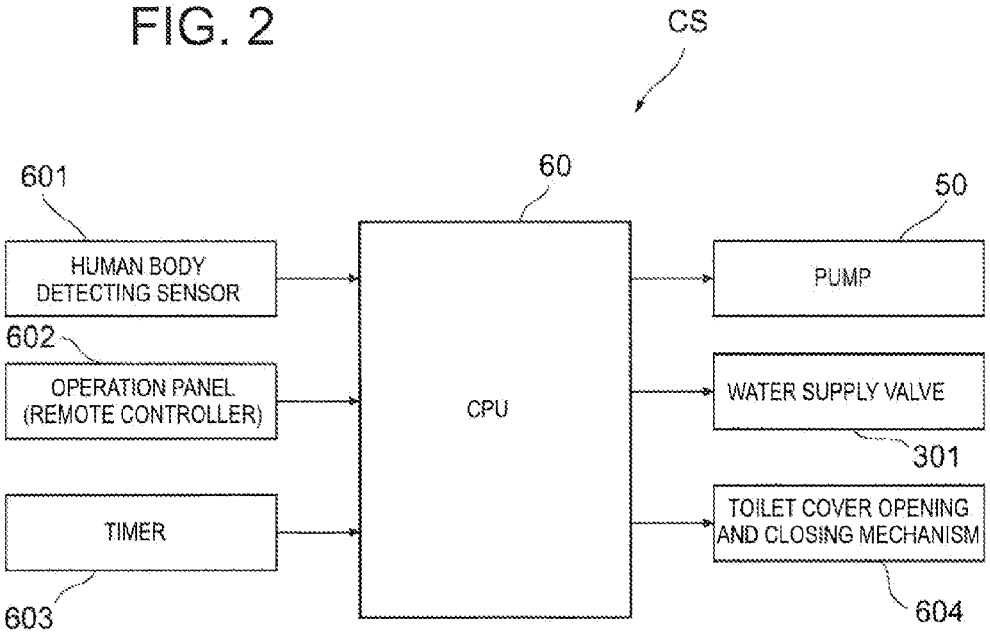
FIG. 2 is a block diagram illustrating a control configuration of the flush toilet device according to the first embodiment of the present invention.

Next, a control configuration of the flush toilet device CS will be described with reference to FIG. 2. FIG. 2 is a block diagram showing a control configuration of the flush toilet device CS. As shown in FIG. 2, the flush toilet device CS includes a CPU 60 (control means), a human body detecting sensor 601 (detecting means), an operation panel 602 for a remote controller, a timer 603, the pump 50, a water supply valve 301, and a toilet cover opening and closing mechanism 604 (toilet cover driving means).

The human body detecting sensor 601 is a sensor for detecting that a user who uses the flush toilet device CS has reached a position in a state immediately before use (a position at which the user stands near the toilet bowl main body 10). The human body detecting sensor 601 outputs a detection signal to the CPU 60.

The operation panel 602 is a panel on which buttons and a display unit for the user operating the flush toilet device CS are formed. The operation panel 602 outputs an operation instruction signal to the CPU 60 in response to a button operation by the user.

The timer 603 is a device capable of measuring time. The timer 603 outputs a time measurement signal indicating time to the CPU 60. In the case of this embodiment, the timer 603 includes two independent timers A and B.

The CPU 60 outputs a predetermined operation instruction signal based on the detection signal output from the human body detecting sensor 601, the operation instruction signal output from the operation panel 602, and the time measurement signal output from the timer 603.

Specifically, the CPU 60 outputs to the pump 50 a siphon instruction signal for siphoning a part of the retained water WS from the discharge water trap conduit 40 to the temporary reservoir tank 501. The pump 50 lowers the piston 502 so as to separate the piston 502 from the temporary reservoir flow path 503 and siphons a part of the retained water WS when the pump 50 receives the siphon instruction signal. The CPU 60 outputs to the pump 50 a returning instruction signal for sending the water, which has been siphoned into the temporary reservoir tank 501, back to the discharge water trap conduit 40. The pump 50 raises the piston 502 so as to cause the piston 502 to approach the temporary reservoir flow path 503 and sends the siphoned water back to the discharge water trap conduit 40 when the pump 50 receives the returning instruction signal.

The CPU 60 outputs a cleaning instruction signal to the water supply valve 301. The water supply valve 301 acts so as to separate a valve body provided therein from a valve seat and flush the flush water through the flush water supply hole 30 when the water supply valve 301 receives the cleaning instruction signal. The water supply valve 301 brings the valve body into contact with the valve seat and stops the supply of the flush water when the cleaning instruction signal is stopped.

The CPU 60 outputs a toilet cover opening instruction signal for opening the toilet cover to the cover opening and closing mechanism 604 (toilet cover driving means). The toilet cover opening and closing mechanism 604 drives a motor provided therein and opens the toilet cover when the toilet cover opening and closing mechanism 604 receives the toilet cover opening instruction signal. The toilet cover opening and closing mechanism 604 drives the motor provided therein and closes the toilet cover when the toilet cover opening and closing mechanism 604 receives a toilet cover closing instruction signal for closing the toilet cover.

Figure 3:
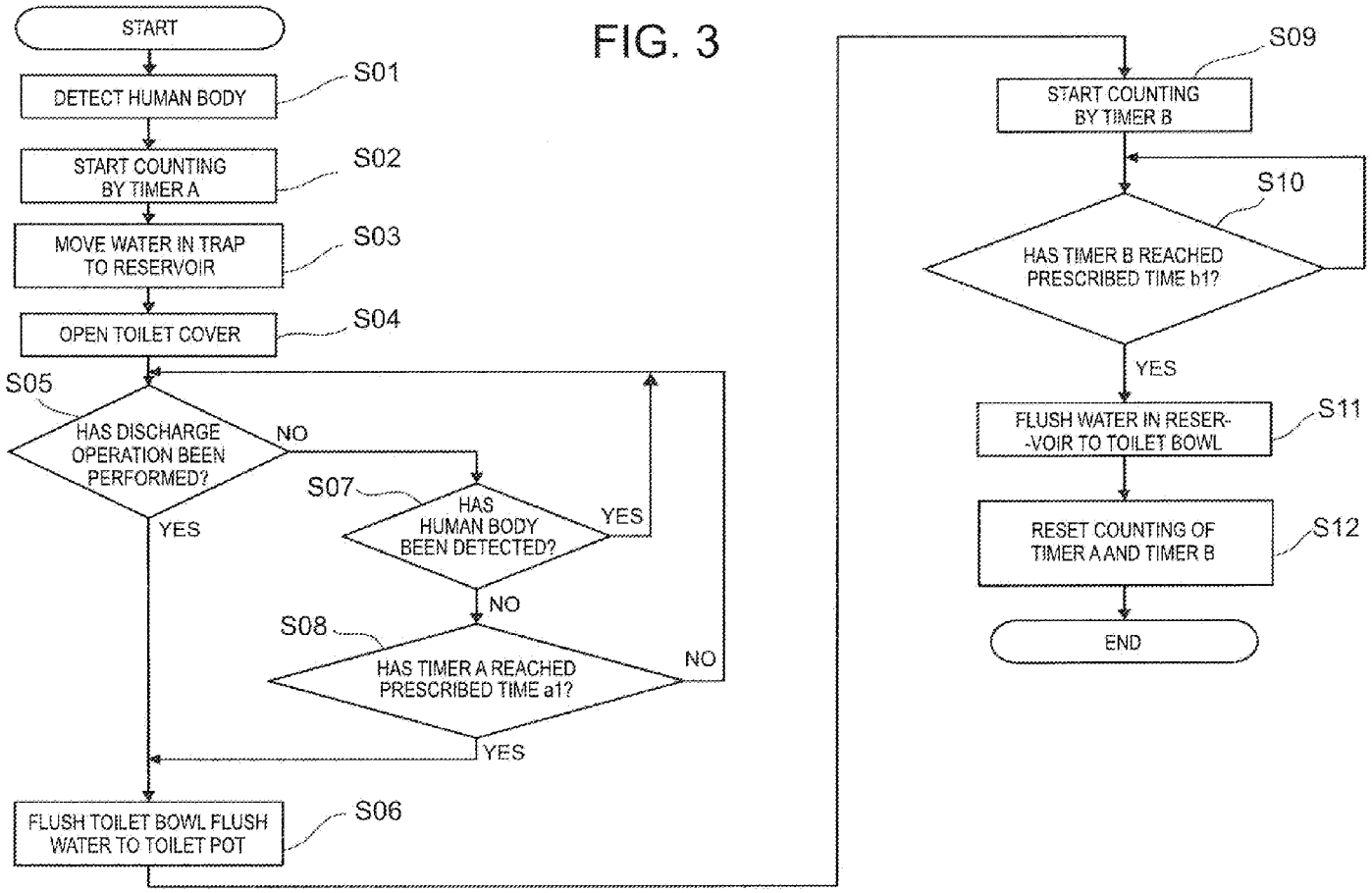
FIG. 3 is a flowchart illustrating operations of the flush toilet device according to the first embodiment of the present invention.

Next, operations of the flush toilet device CS will be described with reference to FIG. 3. FIG. 3 is a flowchart illustrating operations of the flush toilet device CS. In Step S01, the human body detecting sensor 601 detects a user and outputs the detection signal to the CPU 60. In Step S02 following Step S01, the CPU 60 starts time measurement by the timer 603. Specifically, the CPU 60 starts time measurement by the timer A included in the timer 603.

In step S03 following Step S02, the CPU 60 outputs the siphon instruction signal to the pump 50. The pump 50 lowers the piston 502 so as to separate the piston 502 from the temporary reservoir flow path 503 and siphons a part of the retained water WS. This state will be shown in FIG. 4.

Figure 4:
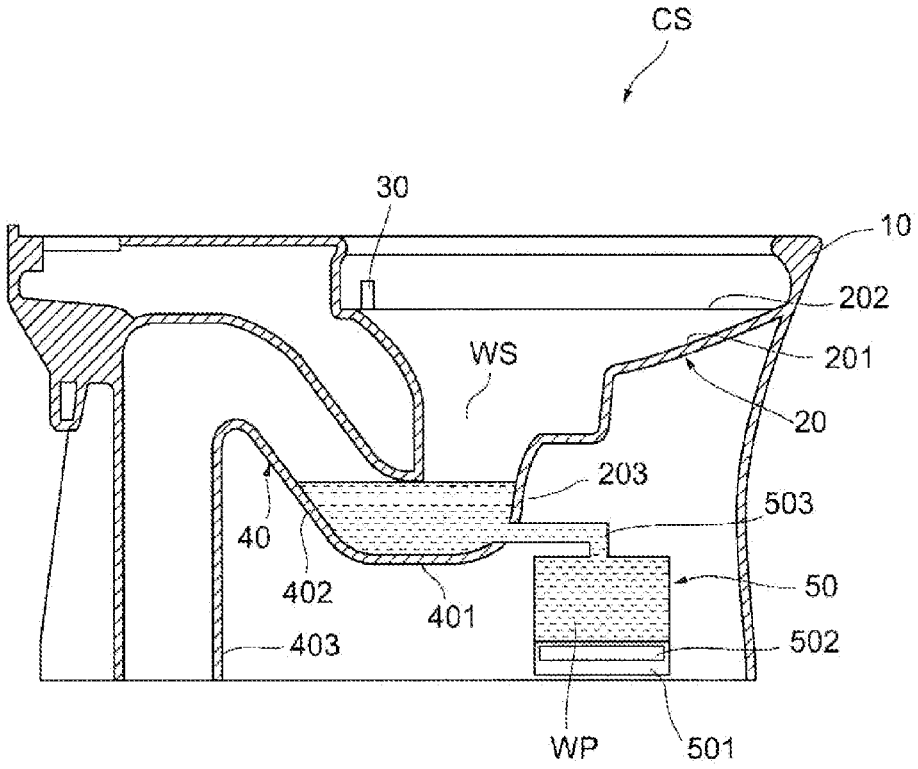
FIG. 4 is a cross-sectional diagram for schematically illustrating operations of the flush toilet device according to the first embodiment of the present invention.

The retained water WS is siphoned via the temporary reservoir flow path 503 and reserved as siphoned water WP in the temporary reservoir tank 501 by the piston 503 lowering as shown in FIG. 4. The retained water WS maintains a constant water level so as not to allow ventilation between the lowering conduit 403 and the side of the bowl 20 even if the pump 50 siphons a part of the retained water WS therein.

Returning to FIG. 3, the CPU 60 outputs the toilet cover opening instruction signal to the toilet cover opening and closing mechanism 604 in Step S04 following Step S03. The toilet cover opening and closing mechanism 604 opens the toilet cover.

In Step S05 following Step S04, it is determined whether or not discharge of waste has been instructed by an operation of the operation panel 602. The processing proceeds to Step S06 if discharge of waste has been instructed, and the processing proceeds to Step S07 if discharge of waste has not been instructed.

Figure 5:
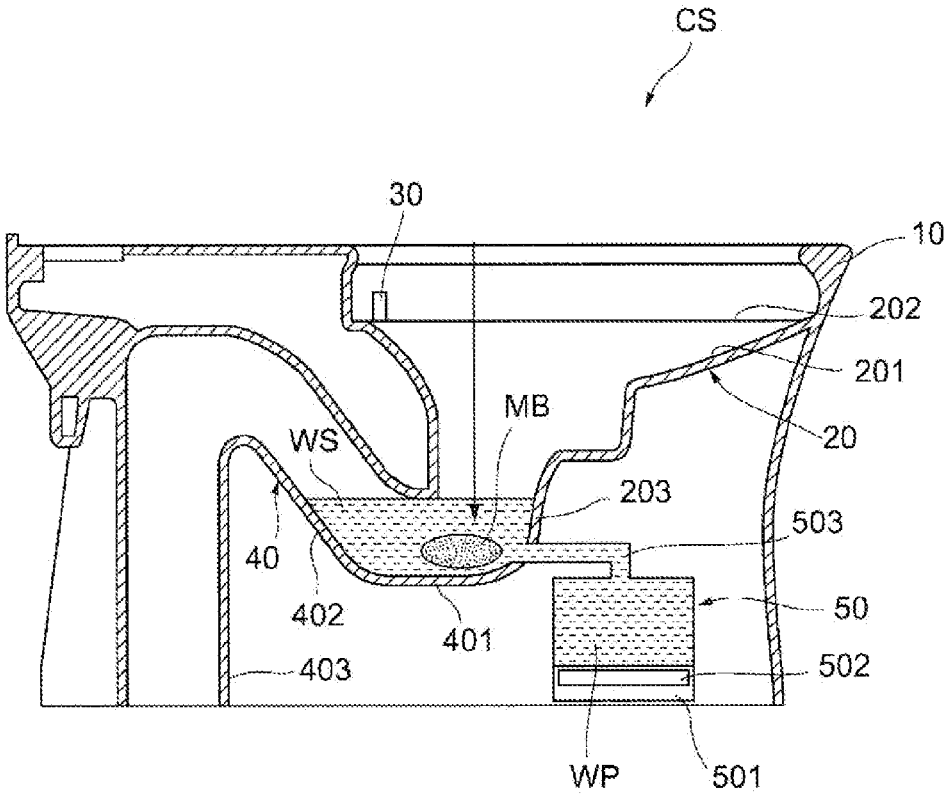
FIG. 5 is a cross-sectional view for schematically illustrating operations of the flush toilet device according to the first embodiment of the present invention.

If discharge of waste has been instructed by the operation of the operation panel 602, the flush toilet device CS is in a state where waste has been egested in the bowl 20. This state will be shown in FIG. 5. As shown in FIG. 5, the egested waste MB enters the retained water WS with a low water level.

Figure 6:
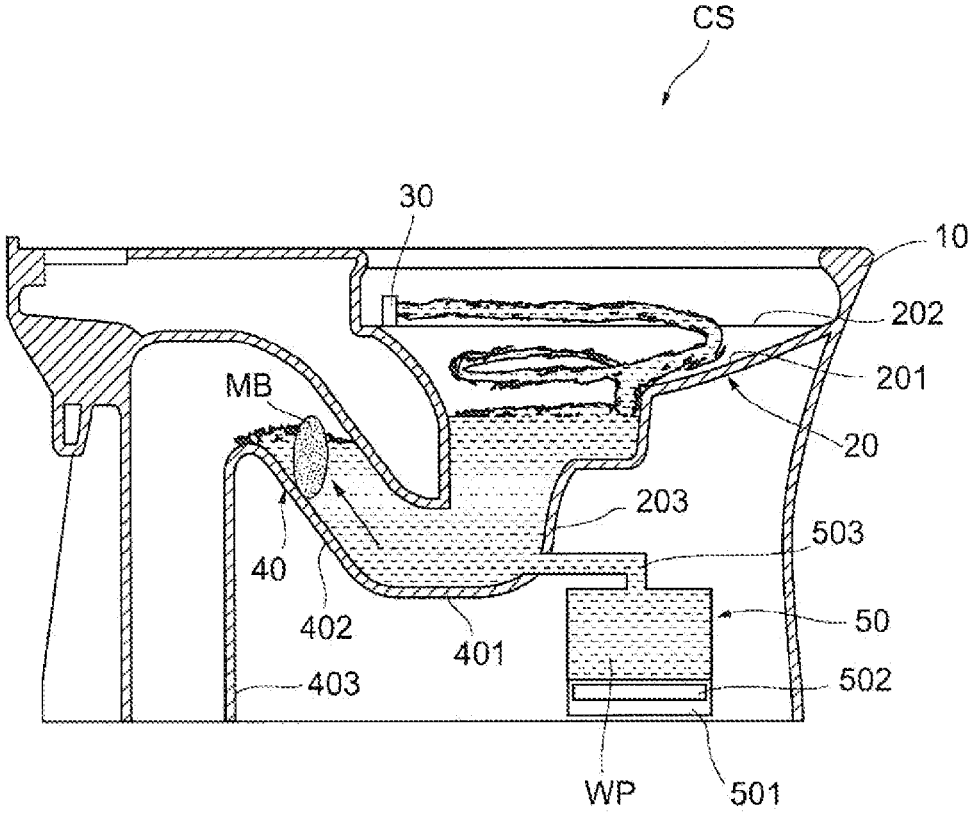
FIG. 6 is a cross-sectional view for schematically illustrating operations of the flush toilet device according to the first embodiment of the present invention.

Returning to FIG. 3, the CPU 60 outputs the cleaning instruction signal to the water supply valve 301 in Step S06. The water supply valve 301 acts so as to separate the valve body provided therein from the valve seat and flush the flush water through the flush water supply hole 30 when the water supply valve 301 receives the cleaning instruction signal. This state will be shown in FIG. 6. As shown in FIG. 6, the flush water is supplied from the flush water supply hole 30 to the inside of the bowl 20. The flush water supplied from the flush water supply hole 30 flows through the rim portion 202 and then flows into the waste receiving surface 201. The flush water, which has cleaned the waste receiving surface 201, flows from the bowl outlet portion 203 into the discharge water trap conduit 40.

Returning to FIG. 3, the human body detecting sensor 601 determines whether or not the detection signal is continuously output in step S07. The processing returns to Step S05 if the detection signal is continuously output from the human body detecting sensor 601, and the processing proceeds to Step S08 if the detection signal is not continuously output from the human body detecting sensor 601.

In Step S08, it is determined whether or not the time measurement by the timer A of the timer 603 has reached prescribed time al. The processing returns to Step S05 if the time measurement by the timer A of the timer 603 has not reached the prescribed time a1, and the processing proceeds to Step S06 if the time measurement by the timer A of the timer 603 has reached the prescribed time a1.

In Step S09 following Step S06, the CPU 60 starts time measurement by the timer 603. Specifically, the CPU 60 starts time measurement by the timer B included in the timer 603.

In Step S10 following Step S09, it is determined whether or not the time measurement by the timer B of the timer 603 has reached prescribed time b1. The processing in Step S10 is continued if the time measurement by the timer B of the timer 603 has not reached the prescribed time b1, and the processing proceeds to Step S11 if the time measurement by the timer B of the timer 603 has reached the prescribed time b1.

In Step S11, the siphoned water WP in the temporary reservoir tank 501 of the pump 50 is sent back to the side of the bowl 20 and the discharge water trap conduit 40. Specifically, the CPU 60 outputs to the pump 50 the returning instruction signal for sending the water, which has been siphoned into the temporary reservoir tank 501, back to the discharge water trap conduit 40. The pump 50 raises the piston 502 so as to causes the piston 502 to approach the temporary reservoir flow path 503 and sends the siphoned water back to the discharge water trap conduit 40 when the pump 50 receives the returning instruction signal. This state will be shown in FIG. 7.

Figure 7:
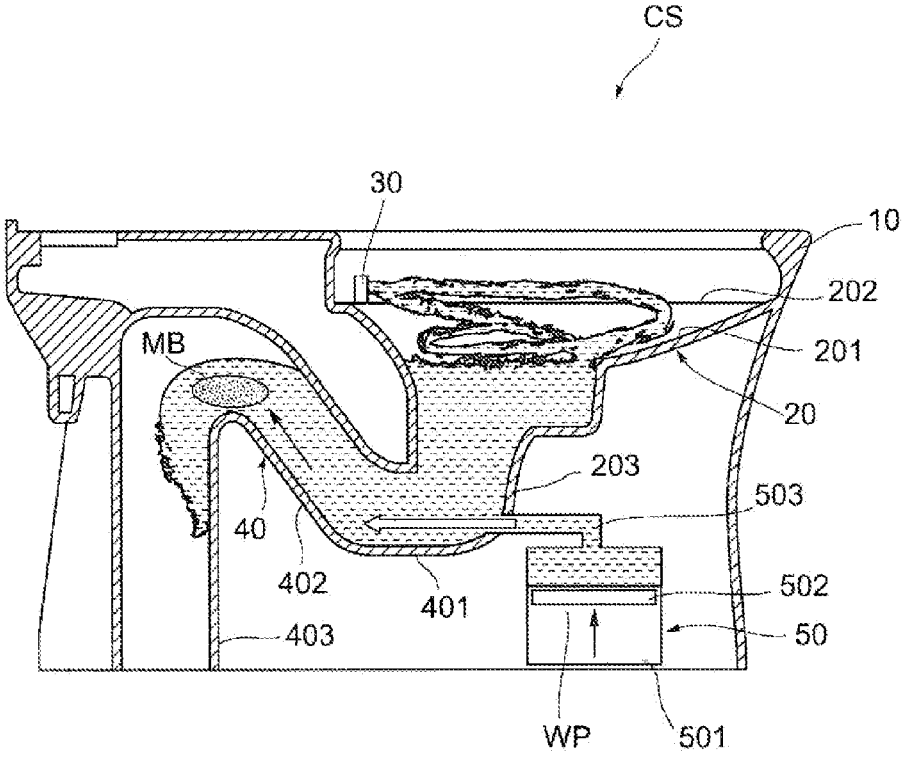
FIG. 7 is a cross-sectional view for schematically illustrating operations of the flush toilet device according to the first embodiment of the present invention.

The siphoned water WP is sent back from a part between the bowl outlet portion 203 and the inlet portion 401 toward the rising conduit 402 by the piston 502 rising as shown in FIG. 7. Since the waste MB has been already flushed into a region from the rising conduit 402 to the lowering conduit 403, the siphoned water WP to be sent back contributes to discharge of the waste MB.

Figure 8:
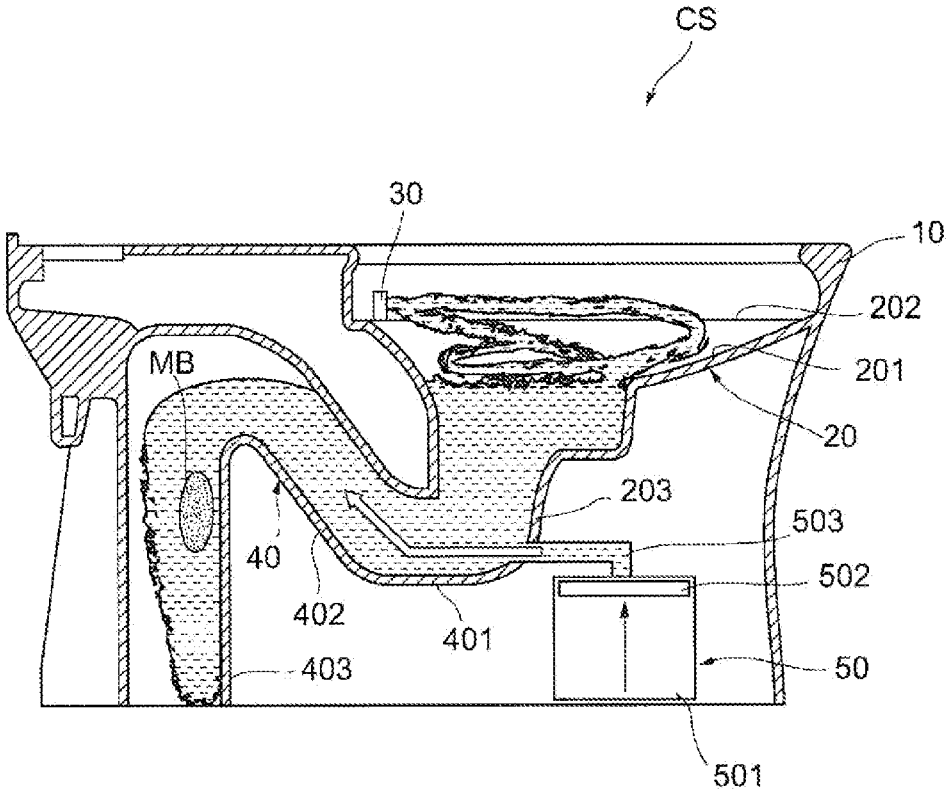
FIG. 8 is a cross-sectional view for schematically illustrating operations of the flush toilet device according to the first embodiment of the present invention.
Figure 9:
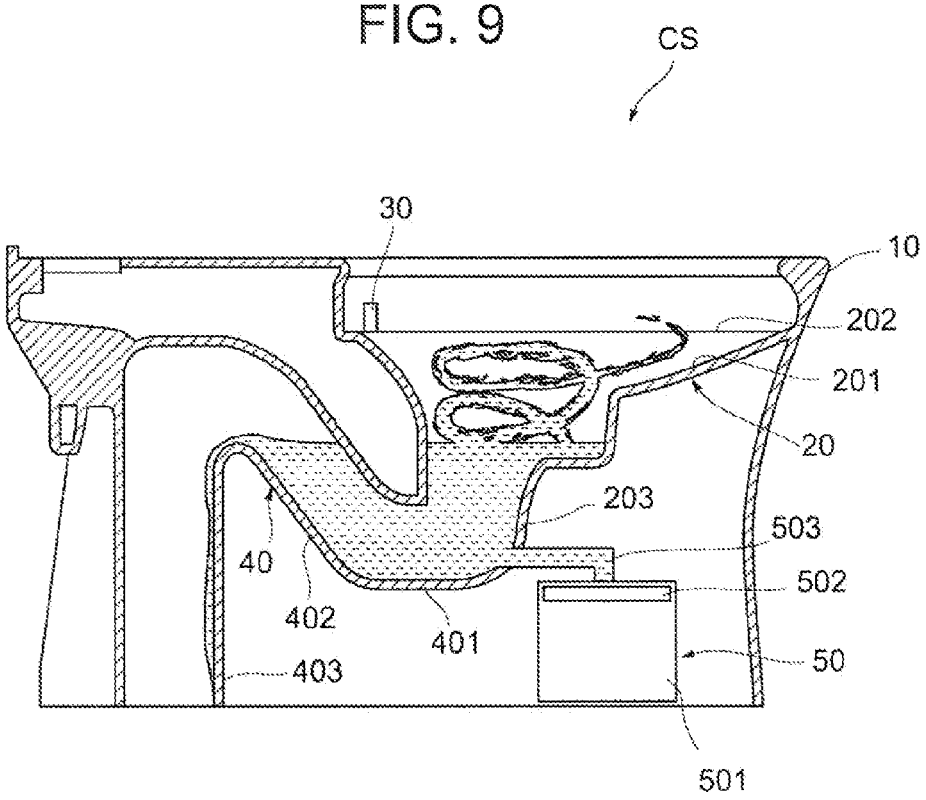
FIG. 9 is a cross-sectional view for schematically illustrating operations of the flush toilet device according to the first embodiment of the present invention.

A state where the piston 502 further rises from the state in FIG. 7 will be shown in FIG. 8. As shown in FIG. 8, the piston 502 rises up to the uppermost part in the temporary reservoir tank 501, and the siphoned water WP is completely sent back to the side of the discharge water trap conduit 40. Thereafter, the cleaning instruction signal output from the CPU 60 to the water supply valve 301 is stopped, and the water supply valve 301 brings the valve body into contact with the valve seat and stops the supply of the flush water (see FIG. 9). If the supply of the flush water is completely stopped, the flush toilet device returns to an initial state as shown in FIG. 1.

Returning to FIG. 3, count of the timer A and the timer B included in the timer 603 is reset in Step S12 following Step S11.

Figure 10:
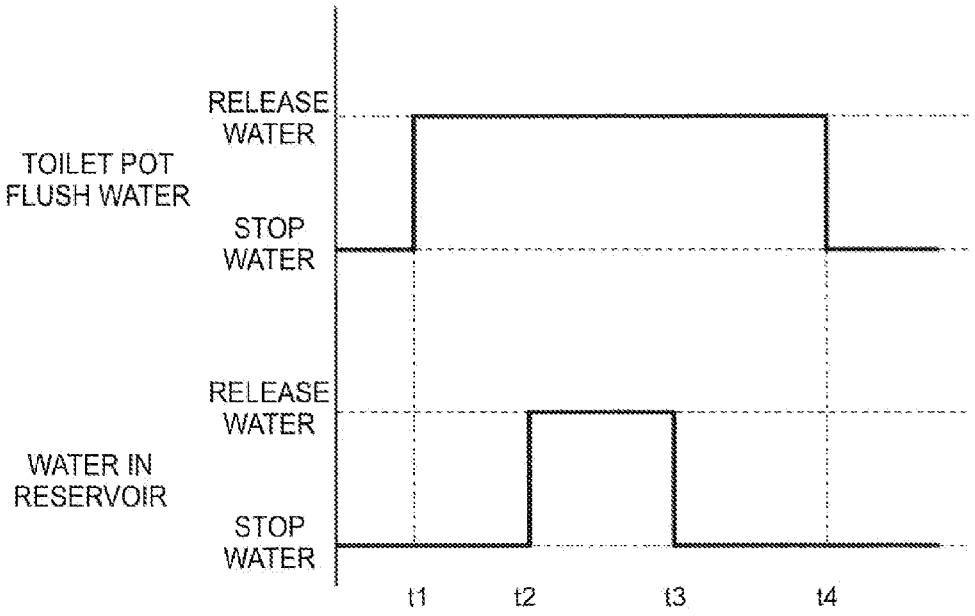
FIG. 10 is a timing chart illustrating operations of the flush toilet device according to the first embodiment of the present invention.

Supply timing of the flush water supplied from the flush water supply hole 30 and supply timing of the siphoned water siphoned into and sent back from the temporary reservoir tank 501 in the aforementioned operations of the flush toilet device CS will be described with reference to FIG. 10. FIG. 10 is a timing chart illustrating operations of the flush toilet device CS.

As shown in FIG. 10, the water supply valve 301 is opened to supply the flush water to the bowl 20 at timing t1, and the supply is stopped at timing t4 in the flush toilet device CS (see Step S06 in FIG. 3 and FIGS. 6, 7, and 8). In addition, the siphoned water WP is sent back from the temporary reservoir tank 501 from timing t2 to timing t3 (see Step S11 in FIG. 3 and FIGS. 7 and 8). Although the siphoned water WP is preferably sent back from the temporary reservoir tank 501 from the start of the supply of the flush water to the bowl 20 to the end of the supply as described above, the timing of returning the siphoned water WP is not limited thereto.

Figure 11:
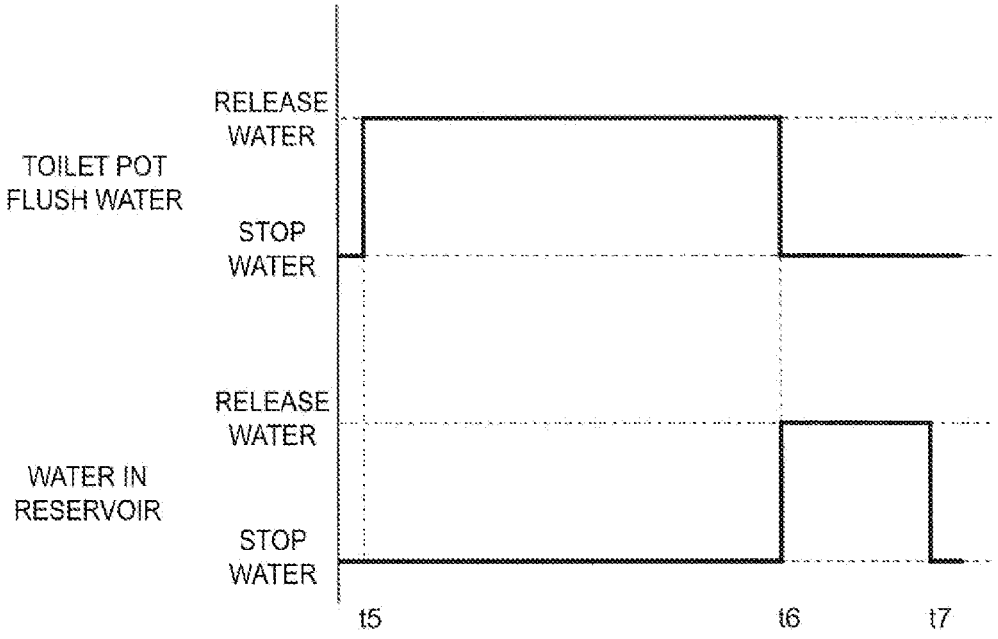
FIG. 11 is a timing chart illustrating a modified example of FIG. 10.

As shown in FIG. 11, it is also preferable to send back the siphoned water WP after the supply of the flush water to the bowl 20 has been completed. In the example shown in FIG. 11, the water supply valve 301 is opened to supply the flush water to the bowl 20 at timing t5, and the supply thereof is stopped at timing t6. In addition, the siphoned water WP is sent back from the temporary reservoir tank 501 from timing t6 (the timing can be slightly before or after the timing t6) to timing t7.

Figure 12:
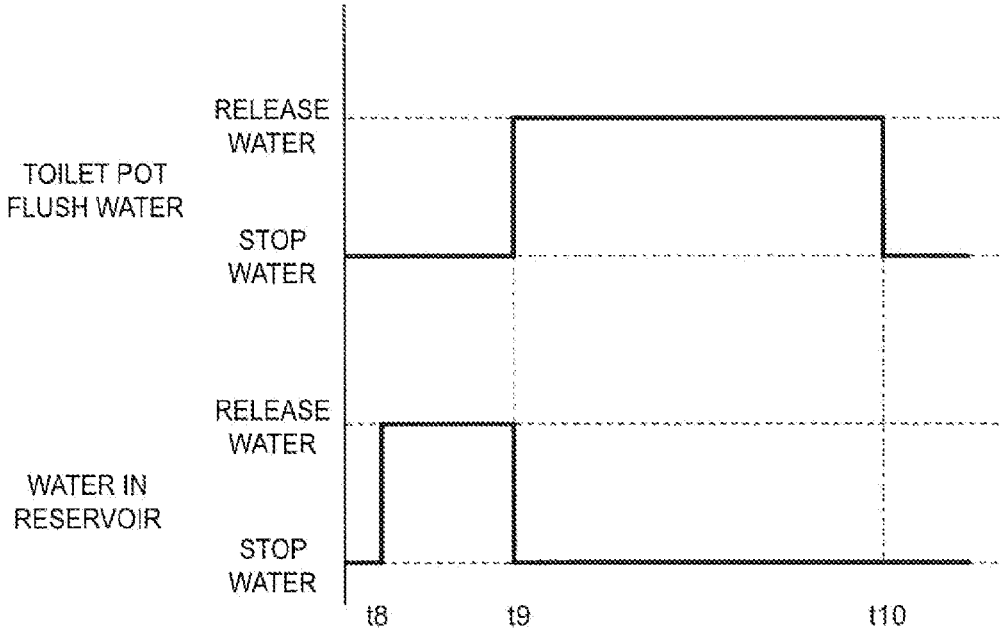
FIG. 12 is a timing chart illustrating a modified example of FIG. 10.

On the other hand, it is also preferable to send back the siphoned water WP prior to the supply of the flush water to the bowl 20 as shown in FIG. 12. In the example shown in FIG. 12, the siphoned water WP is sent back from the temporary reservoir tank 501 from timing t8 to timing t9. The water supply valve 301 is opened to supply the flush water to the bowl 20 at timing t9, and the supply thereof is stopped at timing t10.

As described above, the flush toilet device CS according to this embodiment is a flush toilet device which temporarily receives waste and discharges the waste with flush water and includes the bowl 20 which includes the waste receiving surface 201 for temporarily receiving waste, the water supply hole 30 and the water supply valve 301 as the flush water supply means for supplying the flush water to the bowl 20, the inlet portion 401 which is connected to a lower side of the bowl 20, the rising conduit 402 which is formed so as to extend upward from the inlet portion 401, the lowering conduit 403 which is formed so as to extend downward from the end of the rising conduit 402, and the discharge water trap conduit 40 which reserves water from the inlet portion 401 to at least a part of the rising conduit 402 as retained water WS when the flush toilet device is not in use and forms sealing water with at least a part of the retained water WS.

The flush toilet device CS according to this embodiment further includes the temporary reservoir tank 501 which siphons a part of the retained water WS from the discharge water trap conduit 40 and temporarily reserves the part of the retained water WS as siphoned water WP, the pump 50 which functions as siphon means for siphoning a part of the retained water WS from the discharge water trap conduit 40 to the temporary reservoir tank 501 and as return means for sending the siphoned water WP which is temporarily reserved in the temporary reservoir tank 501 back to the bowl 20 or the discharge water trap conduit 40, and the CPU 60 as control means for controlling behaviors of the pump 50.

The CPU 60 drives the pump 50 as the siphon means before waste is transported to at least the rising conduit 402 by the flush water supplied from the flush water supply hole 30 when the waste is discharged with the flush water after the bowl 20 temporarily receives the waste, and then drives the pump 50 as the return means before the supply of the flush water from the flush water supply hole 30 is completed.

The flush toilet device CS is provided with the discharge water trap conduit 40, and the discharge water trap conduit 40 includes the inlet portion 401 which is connected to the lower side of the bowl 20, the rising conduit 402 which is formed so as to extend upward from the inlet portion 401, and the lowering conduit 403 which is formed so as to extend downward from the end of the rising conduit 402. In addition, the discharge water trap conduit 40 reserves water from the inlet portion 401 to at least a part of the rising conduit 402 as retained water WS and forms the sealing water with at least a part of the retained water WS when the flush toilet device is not in use. The sealing water formed in the discharge water trap conduit 40 plays a role in preventing odor from the sewer conduit from entering a toilet room and preventing pests from entering the toilet room. In order to reliably play this role, the depth of the sealing water formed in the discharged water trap conduit 40 is set such that the sealing water is not lost due to reasons such as evaporation of the retained water which forms the sealing water.

On the other hand, if attention is paid to the flush toilet device CS in use, the waste temporarily received by the bowl 20 falls to the lower side of the bowl 20 and is temporarily reserved at an inlet of the discharge water trap conduit 40. The flush water is supplied in this state, and the waste is flushed to the side of the sewer conduit through the inside of the discharge water trap conduit 40. Accordingly, a part of the retained water WS which forms the sealing water in the discharge water trap conduit 40 is used for preventing the sealing water from being lost when the flush toilet device is not in use. On the other hand, the waste received by the bowl 20 in use is temporarily reserved near the inlet of the discharge water trap conduit 40 and then flushed with the flush water. Since the retained water WS and the flush water on the upstream side (the side of the bowl) from the vicinity of the waste contribute to the discharge of the waste, the retained water WS on the downstream side from the vicinity of the waste in the discharge water trap conduit does not necessarily contribute to the discharge of the waste. If attention is paid to aforementioned features in the discharge water trap conduit 40 of the flush toilet device CS when the flush toilet device CS is in use and not in use, it is not always necessary to reserve the retained water WS for forming the sealing water in the same manner when the flush toilet device CS is in use and not in use, and there is a room for making arrangement regarding how to retain water when the flush toilet device CS is in use and not in use.

Thus, according to this embodiment, the pump 50 as the siphon means is driven before the waste MB is transported to at least the rising conduit 402 by the flush water when the bowl 20 temporarily receives the waste MB and discharges the waste MB with the flush water, and the pump 50 as the return means is then driven before the supply of the flush water is completed. Since the pump 50 which functions as the siphon means and the return means is driven when the bowl 20 discharges the waste MB with the flush water after temporarily receiving the waste MB as described above, the sealing water can be reliably formed without breaking the sealing by the ordinary retained water WS in the discharge water trap conduit 40 when the flush toilet device CS is not in use.

Since the pump 50 is driven as the siphon means before the waste MB is transported to at least the rising conduit 402 by the flush water when the bowl 20 discharges the waste MB with the flush water after temporarily receiving the waste, it is possible to siphon a part of the retained water WS from the discharge water trap conduit 40 to the temporary reservoir tank 501 and temporarily reserve the part of the retained water WS as the siphoned water WP. Thereafter, the pump 50 is driven as the return means before the supply of the flush water is completed, and therefore, it is possible to send the siphoned water WP which is temporarily reserved in the temporary reservoir tank 501 back to the discharge water trap conduit 40.

According to this embodiment, the sealing water is reliably formed without breaking the sealing by the ordinary retained water WS in the discharge water trap conduit 40 when the flush toilet device CS is not in use while the retained water WS in the region, which does not contribute to the discharge of the waste MB in the related art, in the discharge water trap conduit 40 can be siphoned into the temporary reservoir tank 501 and sent back to the discharge water trap conduit 40 at a timing at which the retained water WS can contribute to the transport of the waste MB when the flush toilet device CS is in use, as described above. Accordingly, it is possible to provide a flush toilet device CS with a further enhanced water saving performance by making arrangement for dealing with the retained water WS in the discharge water trap conduit 40.

In addition, in the flush toilet device CS according to this embodiment, the amount of retained water WS siphoned by the pump 50 as the siphon means from the discharge water trap conduit 40 to the temporary reservoir tank 501 is an amount with which 40 does not break the sealing of the sealing water formed in the discharge water trap conduit 40.

Since the sealing in the discharge water trap conduit 40 does not break even if the pump 50 as the siphon means siphons the retained water WS from the discharge water trap conduit 40 to the temporary reservoir tank 501 as described above, it is possible to reliably secure the function of the discharge water trap conduit 40 even when the flush toilet device CS is in use. Accordingly, it is possible to play a role in preventing odor from the sewer conduit from entering a toilet room and preventing pests from entering the toilet room even if the retained water WS is siphoned from the discharge water trap conduit 40 when the flush toilet device CS is in use.

In addition, the flush toilet device CS according to this embodiment includes the human body detecting sensor 601 as the detecting means for detecting the state immediately before use, namely before a user egests waste in the bowl 20, and the CPU 60 drives the pump 50 as the siphon means in response to the detection of the state immediately before use by the human body detecting sensor 601.

Since the pump 50 as the siphon means is driven in response to the detection of the state immediately before use by the human body detecting sensor 601 as described above, the retained water WS is siphoned from the discharge water trap conduit 40 during a necessary minimum period. In addition, since the state immediately before use, namely before a user egests waste, is detected, the retained water WS with the waste MB mixed therein is not siphoned into the temporary reservoir tank 501. With such a configuration, it is possible to reliably avoid a situation that the waste MB adheres to the inside of the temporary reservoir tank 501 and growth of bacteria is promoted in the temporary reservoir tank 501. Accordingly, it is possible to reliably avoid growth of bacteria in the sealing water formed in the discharge water trap conduit 40 which communicates with the temporary reservoir tank 501 and avoid a problem of the discharge water trap conduit 40 being contaminated with bacteria. In addition, it is also possible to avoid the waste MB remaining in the sealing water in the discharge water trap conduit 40 even if the siphoned water WP in the temporary reservoir tank 501 is sent back to the discharge water trap conduit 40.

In addition, the flush toilet device CS according to this embodiment includes the toilet cover which covers the bowl 20 and the toilet cover opening and closing mechanism 604 which drives the toilet cover, and the CPU 60 controls the toilet cover opening and closing mechanism 604 so as to maintain a state where the toilet cover is closed until the pump 50 as the siphon means is driven and open the toilet cover after driving the pump 50 as the siphon means.

Since the state where the toilet cover is closed is maintained until the pump 50 is driven as the siphon means as described above, it is possible to reliably prevent the waste MB from entering the discharge water trap conduit 40 before the retained water WS in the discharge water trap conduit 40 is siphoned into the temporary reservoir tank 501. In addition, it is possible to inform a user that the flush toilet device CS is available, by opening the toilet cover after driving the pump 50 as the siphon means.

In addition, in the flush toilet device CS according to this embodiment, the CPU 60 drives the pump 50 as the return means based on the supply of the flush water. In this embodiment, the siphoned water WP is utilized for transporting waste and forming the sealing water after cleaning by sending the siphoned water WP, which has been siphoned into the temporary reservoir tank 501, back to the discharge water trap conduit 40. It is essential to send the siphoned water WP back to the discharge water trap conduit 40 after a user completes an egesting action in order to utilize the siphoned water WP reserved in the temporary reservoir tank 501 for transporting waste and forming the sealing water as described above. Accordingly, it is not preferable to send the siphoned water WP back to the discharge water trap conduit 40 during an egesting action or before egestion is completed. Thus, it is possible to reliably send the siphoned water WP back to the discharge trap conduit 40 after a user completes an egesting action by sending the siphoned water WP back to the discharge water trap conduit 40 in conjunction with the supply of the flush water and to thereby save water for the flush toilet device CS by utilizing the siphoned water WP for transporting the waste MB and forming the sealing water.

In addition, in the flush toilet device CS according to this embodiment, the CPU 60 drives the pump 50 as the return means after the supply of the flush water starts. As described above, it is possible to send the siphoned water WP in the temporary reservoir tank 501 back to the discharge water trap conduit 40 at a delayed timing after the supply of the flush water. Accordingly, it is possible to avoid a situation that the retained water WS in the discharge water trap conduit 40 is simply siphoned and simply returned to the discharge water trap conduit 40 and save water for the flush toilet device CS by reliably utilizing the siphoned water WP in the temporary reservoir tank 501 for transporting the waste MB.

In addition, in the flush toilet device CS according to this embodiment, the CPU 60 preferably drives the pump 50 as the return means after the supply of the flush water is completed (see FIG. 11). Since the siphoned water WP in the temporary reservoir tank 501 is sent back to the discharge water trap conduit 40 after the supply of the flush water is completed as described above, the siphoned water WP can be sent back without being influenced by water flow in the supply of the flush water. Accordingly, it is possible to realize the sending back of the siphoned water WP with small transport force by the pump 50 as the return means.

In addition, in the flush toilet device CS according to this embodiment, the CPU 60 preferably drives the pump 50 as the return means such that the flush water follows the siphoned water WP, which is sent back from the temporary reservoir tank 501 to the discharge water trap conduit 40 by driving the pump 50 as the return means, and flows into the discharge water trap conduit 40 (see FIG. 12).

With the above configuration in which the flush water follows the siphoned water WP, which is sent back from the temporary reservoir tank 501 to the discharge water trap conduit 40, and flows into the discharge water trap conduit 40, it is possible to configure the flush toilet device CS such that the flush water flows to the sewage side while catching the siphoned water WP. Accordingly, it is possible to avoid a situation that the retained water WS in the discharge water trap conduit 40 is simply siphoned and simply returned to the bowl and the discharge water trap portion. In addition, since the flush water catches the siphoned water WP and flows to the sewage side even if the siphoned water WP is contaminated, for example, contamination does not remain in the discharge water trap conduit 40, and cleaning can be reliably performed.

In addition, the flush toilet device CS according to this embodiment is configured such that the siphoned water WP to be sent back from the temporary reservoir tank 501 to the discharge water trap conduit 40 is supplied along a discharge direction of the waste MB in the discharge water trap conduit 40. Since the siphoned water WP to be sent back to the discharge water trap conduit 40 is supplied along the discharge direction of the waste MB in the discharge water trap conduit 40 as described above, it is possible to cause the water flow to be sent back to contribute to transport of the waste MB.

Figure 13:
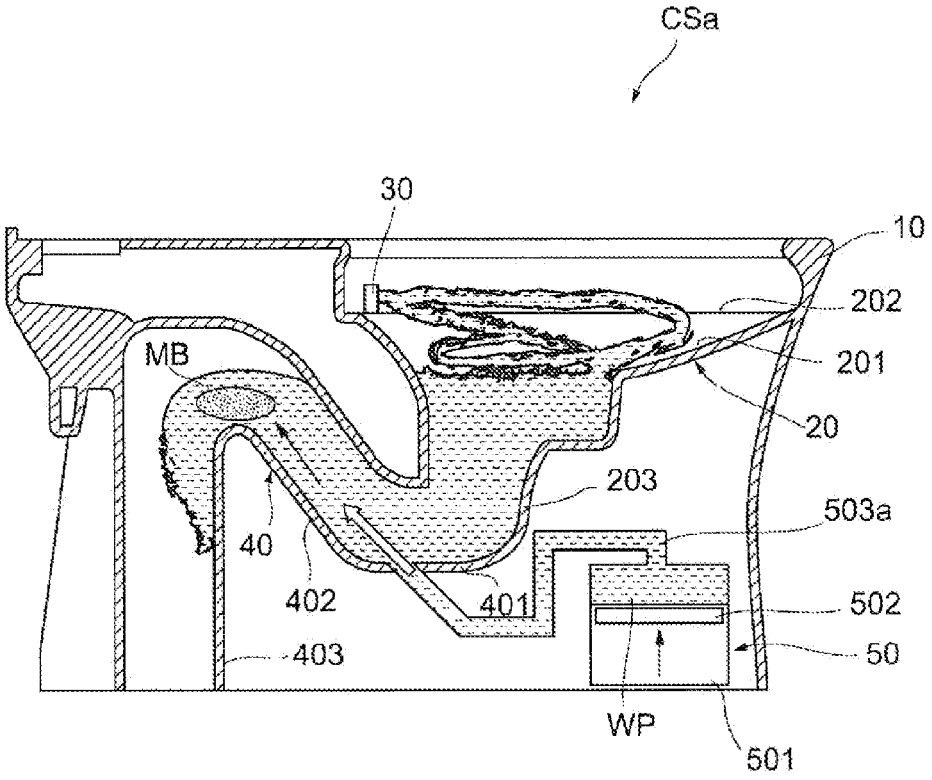
FIG. 13 is a cross-sectional view schematically illustrating a flush toilet device according to a modified example.

In addition, the flush toilet device CS according to this embodiment is configured such that the siphoned water WP to be sent back from the temporary reservoir tank 501 to the discharge water trap conduit 40 is supplied toward the rising conduit 402. A more preferable example of this configuration will be shown in FIG. 13. In a flush toilet device CSa shown in FIG. 13, a temporary reservoir flow path 503*a* of the pump 50 is connected between the rising conduit 402 and the inlet portion 401 along the rising conduit 402. Since the siphoned water WP to be sent back to the discharge water trap conduit 40 is supplied toward the rising conduit 402 in this preferable mode, it is possible to cause the flow of water to be sent back to further contribute to the transport of the waste MB.

Figure 14:
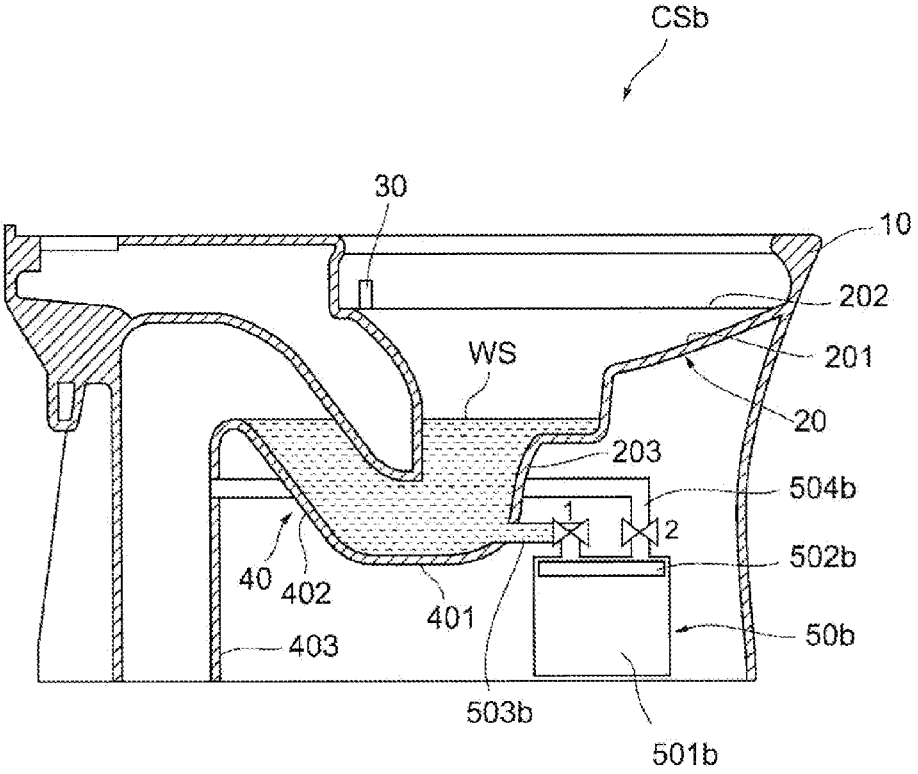
FIG. 14 is a cross-sectional view schematically illustrating a flush toilet device according to a modified example.

From a viewpoint of the transport of the waste MB, the siphoned water WP to be sent back is preferably sent back to a part other than the rising conduit 402. FIG. 14 shows an example in which the siphoned water WP is sent back to the lowering conduit 403. In a flush toilet device CSb, a pump 50*b* is configured by a temporary reservoir tank 501*b*, a piston 502*b*, a siphon flow path 503*b*, and a return flow path 504*b* as shown in FIG. 14. The siphon flow path 503*b* connects the inlet portion 401 of the discharge water trap conduit 40 to the temporary reservoir tank 501*b* and is provided with an opening and closing valve 1. The return flow path 504*b* connects the lowering conduit 403 of the discharge water trap conduit 40 to the temporary reservoir tank 501*b* and is provided with an opening and closing valve 2.

When the pump 50*b* siphons the retained water WS, the opening and closing valve 1 is opened, the opening and closing valve 2 is closed, and the piston 502*b* is lowered. On the other hand, when the water siphoned by the pump 50*b* is sent back, the opening and closing valve 1 is closed, the opening and closing valve 2 is opened, and the piston 502*b* is raised. In so doing, the retained water in the discharge water trap conduit 40 is siphoned, and the siphoned water WS is sent back to the lowering conduit 403. In addition, it is also possible to supply the water to be sent back to the bowl 20 if the return flow path 504*b* is connected to the bowl 20.

In addition, in the flush toilet device CS according to this embodiment, the CPU 60 droves the pump 50 as the siphon means in response to detection of a user by the human body detecting sensor 601, and then drives the pump 50 as the return means in response to a state in which the human body detecting sensor 601 does not detect the user.

When the pump 50 as the siphon means is driven in response to the detection of a user by the human body detecting sensor 601, it is assumed that the user performs an egesting action and supply of the flush water is then performed, though there is also a different case in the implementation. Even if the user reaches a position corresponding to the state immediately before use, the user leaves without using the flush toilet device CS in some cases, and some countermeasure is required. Thus, according to this embodiment, it is possible to reliably send back the siphoned water WP even if the user leaves without actually using the flush toilet device CS, by driving the pump 50 as the siphon means in response to the detection of the user by the human body detecting sensor 601 and driving the pump 50 as the return means in response to the state in which the human body detecting sensor 601 does not detect the user.

In addition, in the flush toilet device CS according to this embodiment, the CPU 60 preferably drives the pump 50 as the siphon means in response to the detection of the state immediately before use by the human detecting sensor 601 and then driving the pump 50 as the return means in response to elapse of a predetermined time.

When the pump 50 as the siphon means is driven in response to the detection of a user by the human body detecting sensor 601, it is assumed that the user performs an egesting action and supply of the flush water is then performed, though there is also a different case in the implementation. Even if the user reaches a position corresponding to the state immediately before use, the user leaves without using the flush toilet device CS in some cases, and some countermeasure is required. Thus, according to this embodiment, it is possible to reliably send back the siphoned water WP even if the user leaves without actually using the flush toilet device CS, by driving the pump 50 as the siphon means in response to the detection of the user by the human body detecting sensor 601 and driving the pump 50 as the return means in response to the elapse of a predetermined time.

Figure 15:
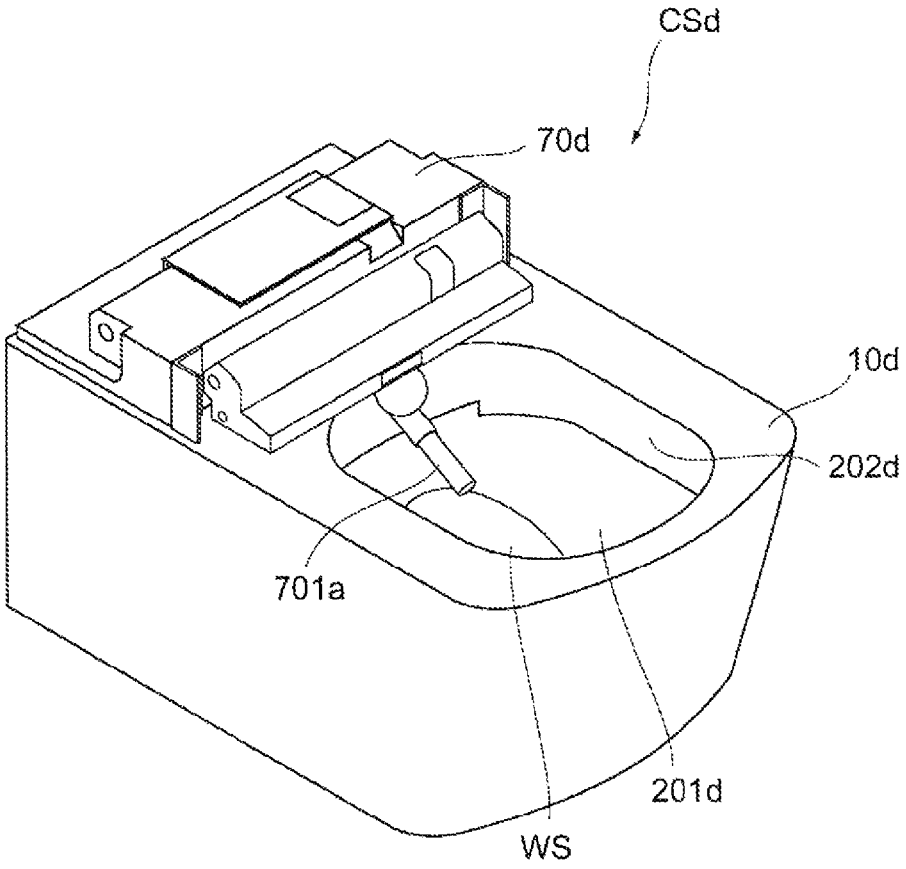
FIG. 15 is a perspective view schematically illustrating a flush toilet device according to a second embodiment of the present invention.
Figure 16:
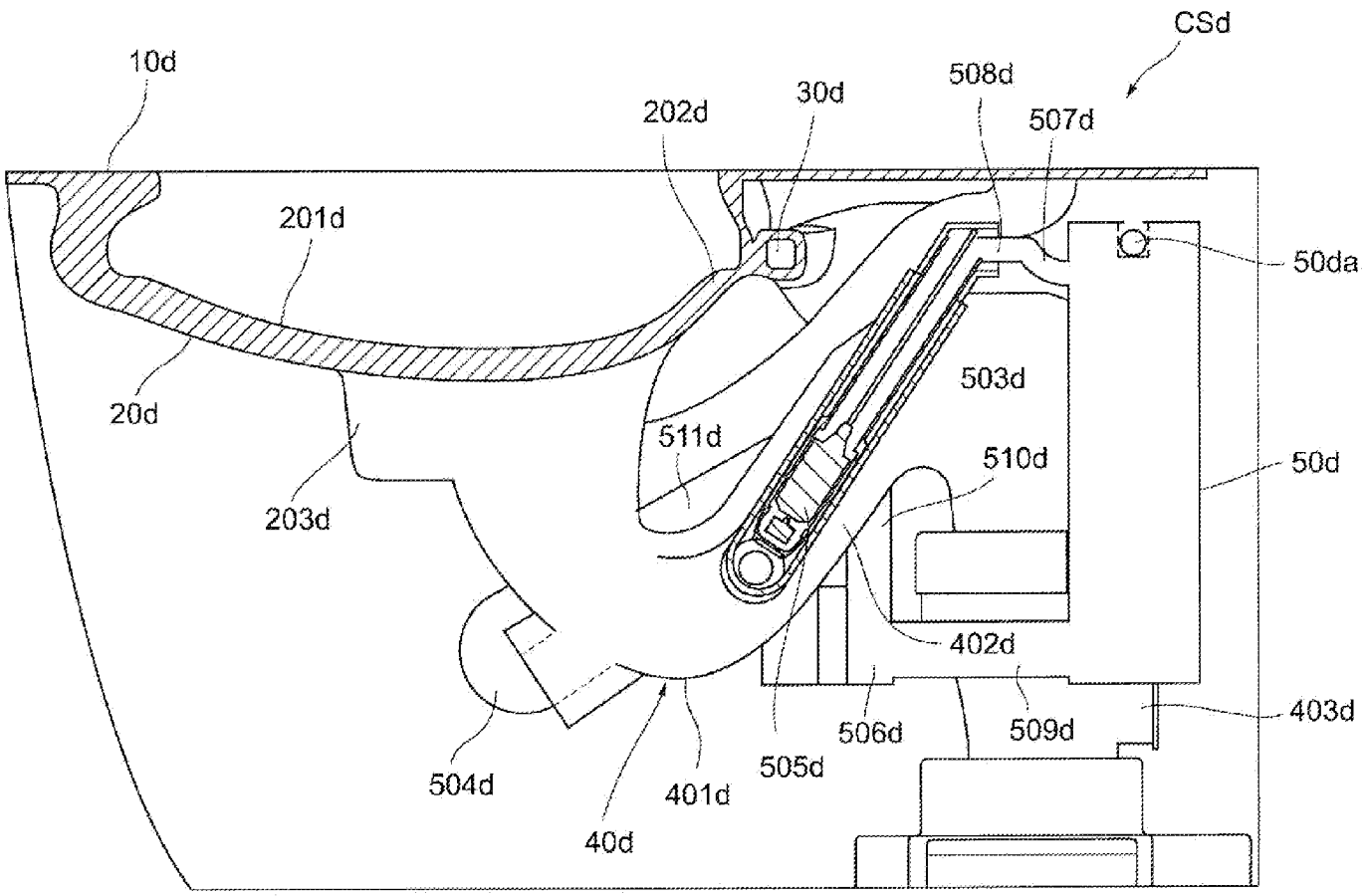
FIG. 16 is a cross-sectional view schematically illustrating the flush toilet device according to the second embodiment of the present invention.

A flush toilet device according to a second embodiment of the present invention will be described with reference to FIGS. 15 and 16. FIG. 15 is an outline perspective view illustrating a flush toilet device CSd according to the second embodiment of the present invention. FIG. 16 is a cross-sectional view schematically illustrating the flush toilet device CSd according to the second embodiment of the present invention. A toilet bowl main body 10*d* in the flush toilet device CSd is mainly depicted in FIG. 16, and descriptions of a toilet seat, a toilet cover, a water supply valve for flush water, a remote controller, and an operation panel thereof is omitted.

As shown in FIG. 15, the flush toilet device CSd includes a toilet bowl main body 10*d* and a sanitary cleaning device 70*d*. The sanitary cleaning device 70*d* is configured so as to be able to discharge flush water for cleaning a limited area of a user from a cleaning nozzle 701*d*.

As shown in FIG. 16, the toilet bowl main body 10*d* configures the flush toilet device which temporarily receives waste and discharges the waste with the flush water, and includes a bowl 20*d*, a discharge water trap conduit 40*d*, and a temporary reservoir tank 50*d*. The bowl 20 includes a waste receiving surface 201*d* which is a part of the toilet bowl main body 10 and temporarily receives waste, a rim portion 202*d* which flushes the flush water to the waste receiving surface 201*d*, and a bowl outlet portion 203*d* which flushes the waste to the discharge water trap conduit 40*d*. The rim portion 202*d* is formed at an upper peripheral edge portion of the waste receiving surface 201*d*. A flush water supply hole 30*d* faces the rim portion 202*d*. The bowl outlet portion 203*d* is formed on the lower side of the waste receiving surface 201*d*.

The discharge water trap conduit 40*d* is a part which receives waste and flush water from the bowl 20*d* and flushes the waste and the flush water in the direction of the sewer conduit. The discharge water trap conduit 40*d* includes an inlet portion 401*d*, a rising conduit 402*d*, and a lowering conduit 403*d*. The inlet portion 401*d* is a part which is connected to the bowl outlet portion 203*d* formed below the waste receiving surface 201*d* of the bowl 20*d*. The inlet portion 401*d* receives waste and flush water from the bowl outlet portion 203*d* and flushes the waste and the flush water into the rising conduit 402*d*.

The rising conduit 402*d* is a part which is formed on the side further downstream than the inlet portion 401*d* and a part which is formed so as to extend upward from the inlet portion 401*d*. Accordingly, the bowl outlet portion 203*d*, the inlet portion 401*d*, and the rising conduit 402*d* are connected to each other and form a U-shaped conduit as a whole.

The lowering conduit 403*d* is a part which is formed on the side further downstream than the rising conduit 402*d* and a part which is formed so as to extend downward from the end portion of the rising conduit 402*d* on the downstream side.

Accordingly, retained water WS reserved in the U-shaped conduit which is formed by the bowl outlet portion 203*d*, the inlet portion 401*d*, and the rising conduit 402*d* can be reserved up to a connection part between the rising conduit 402*d* and the lowering conduit 403*d*. As shown in FIG. 16, water is reserved from the inlet portion 401*d* to at least a part of the rising conduit 402*d* as retained water WS when the flush toilet device CSd is not in use, and sealing water is formed with at least a part of the retained water.

The temporary reservoir tank 50*d* is a tank for siphoning a part of the retained water WS from the discharge water trap conduit 40*d* and temporarily reserving the water as the siphoned water. The discharge water trap conduit 40*d* and the temporary reservoir tank 50*d* are connected to each other via a siphon conduit 503*d* (first siphon part), a bent portion 508*d* (top portion), and a siphon conduit 507*d* (second siphon part).

The siphon conduit 503*d* is a part which is connected to the discharge water trap conduit 40*d*. The siphon conduit 503*d* inclines and extends upward from a part which is connected to the discharge water trap conduit 40*d*. The bent portion 508*d* is connected to the siphon conduit 503*d*, and the bent portion 508*d* is connected to the siphon conduit 507*d*. The siphon conduit 507*d* inclines and extends downward from a part which is connected to the bent portion 508*d* and is connected to an upper end of the temporary reservoir tank 50*d*. A ventilation hole 50*da* is formed in the upper end of the temporary reservoir tank 50*d* at a separate position from the part which is connected to the siphon conduit 507*d*. In addition, although the siphon conduit 503*d* is connected to the discharge water trap conduit 40*d* in this embodiment, the siphon conduit 503*d* may be connected to the bowl outlet portion 203*d*.

Figure 17:
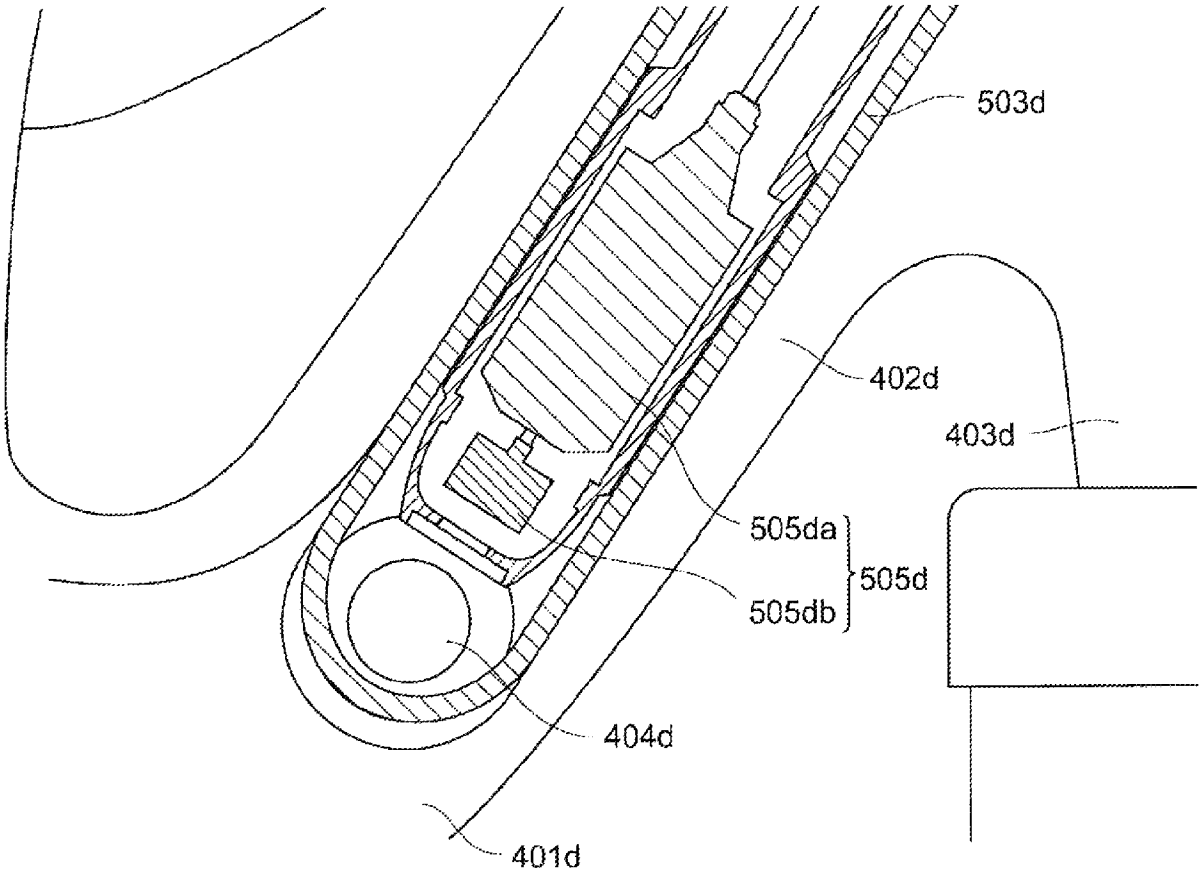
FIG. 17 is an enlarged diagram of a vicinity of a siphon pump shown in FIG. 16.

The siphon conduit 503*d* is provided with a siphon pump 505*d*. The siphon pump 505*d* is a turbo type pump. An enlarged cross-sectional view of the siphon pump 505*d* will be shown in FIG. 17. As shown in FIG. 17, the siphon pump 505*d* includes a motor 505*da* and an impeller 505*db*. The impeller 505*db* is rotated by rotating the motor 505*da*, and siphons water around the impeller 505*db*, and sends the water to the side of the motor 505*da*. Accordingly, the siphon pump 505*d* is configured so as not to be able to siphon water if there is no water around the impeller 505*d*.

Figure 18:
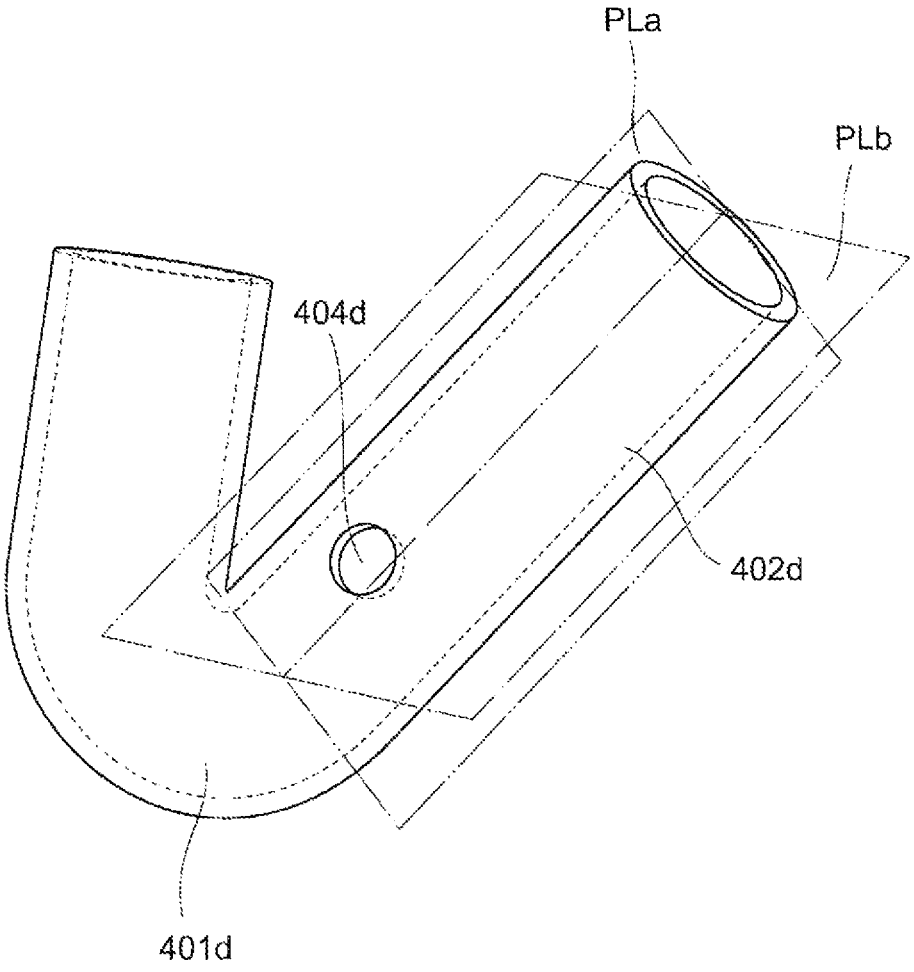
FIG. 18 is a diagram for illustrating a formation position of a communicating hole at which a discharge water trap conduit and a siphon flow path are connected to each other.

The siphon conduit 503*d* is connected to a suctioning port 404*d* which is provided at the rising conduit 402*d* of the discharge water trap conduit 40*d*. A formation position of the suctioning port 404*d* will be described with reference to FIG. 18. As shown in FIG. 18, the discharge water trap conduit 40*d* is formed so as to be bent from the inlet portion 401*d* to the rising conduit 402*d*. In the case of this embodiment, the discharge water trap conduit 40*d* is bent along a plane PLa. The suctioning port 404*d* is formed at a position at which a center thereof penetrates through a plane PLb which passes through a center axis of the rising conduit 402 and is orthogonal to the plane PLa.

Figure 19:
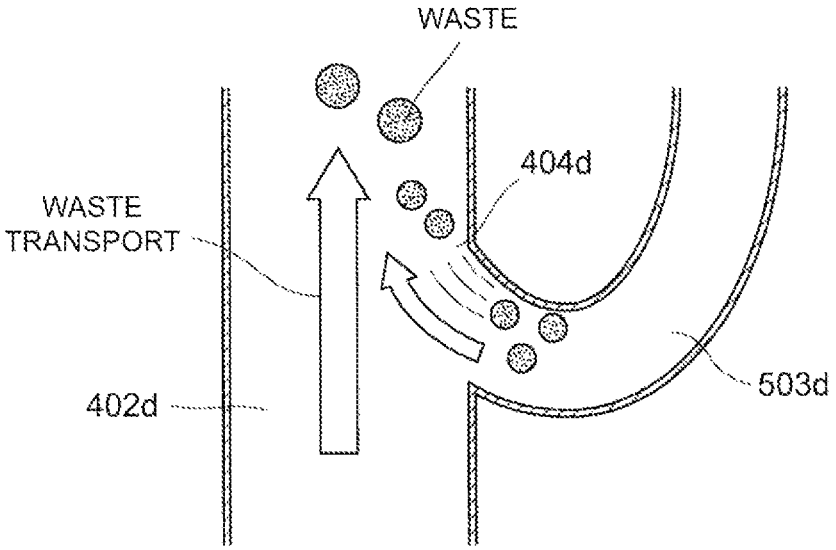
FIG. 19 is a diagram for illustrating a connection state of the siphon flow path to the discharge water trap conduit.

In addition, the siphon conduit 503*d* is connected such that a part immediately after branching from the discharge water trap conduit 40*d* is directed to the upstream side of the discharge water trap conduit 40*d*. FIG. 19 schematically shows this state. As shown in FIG. 19, waste which is transported by flush water flowing in the rising conduit 402*d* does not enter the side of the siphon conduit 503*d*, and rather, the flush water flows toward the downstream side of the rising conduct 402*d* so as to pull the waste out of the siphon conduit 503*d* since the siphon conduit 503*d* is connected so as to be directed to the upstream side of the rising conduit 402*d*.

Returning to FIG. 16, the description will be continued. The flush toilet device CS is configured such that the siphoned water reserved in the temporary reservoir tank 50*d* can be returned to the discharge water trap conduit 40*d*. The temporary reservoir tank 50*d* and the discharge water trap conduit 40*d* are connected to each other via a return conduit 509*d*, a return conduit 510*d* (first return part), a return conduit 511*d* (second return part), and a return conduit 504*d*.

The return conduit 509*d* is a part which is connected to the temporary reservoir tank 50*d*. The return conduit 509*d* extends in a substantially horizontal direction from a lower end of the temporary reservoir tank 50*d*. The return conduit 510*d* is connected to the return conduit 509*d*. The return conduit 510*d* extends so as to stand in a substantially vertical direction from a part which is connected to the return conduit 509*d*. The return conduit 511*d* is connected to the return conduit 510*d*. The return conduit 511*d* inclines and extends obliquely downward from a part which is connected to the return conduit 510*d*. The return conduit 504*d* is connected to the return conduit 511*d*. The return conduit 504*d* is bent from a part which is connected to the return conduit 511*d* and connected to the inlet portion 401*d* of the discharge water trap conduit 40*d*.

A return pump 506*d* is provided between the return conduit 509*d* and the return conduit 510*d*. By driving the return pump 506*d*, the siphoned water in the temporary reservoir tank 50*d* is returned to the discharge water trap conduit 40*d*.

Figure 20:
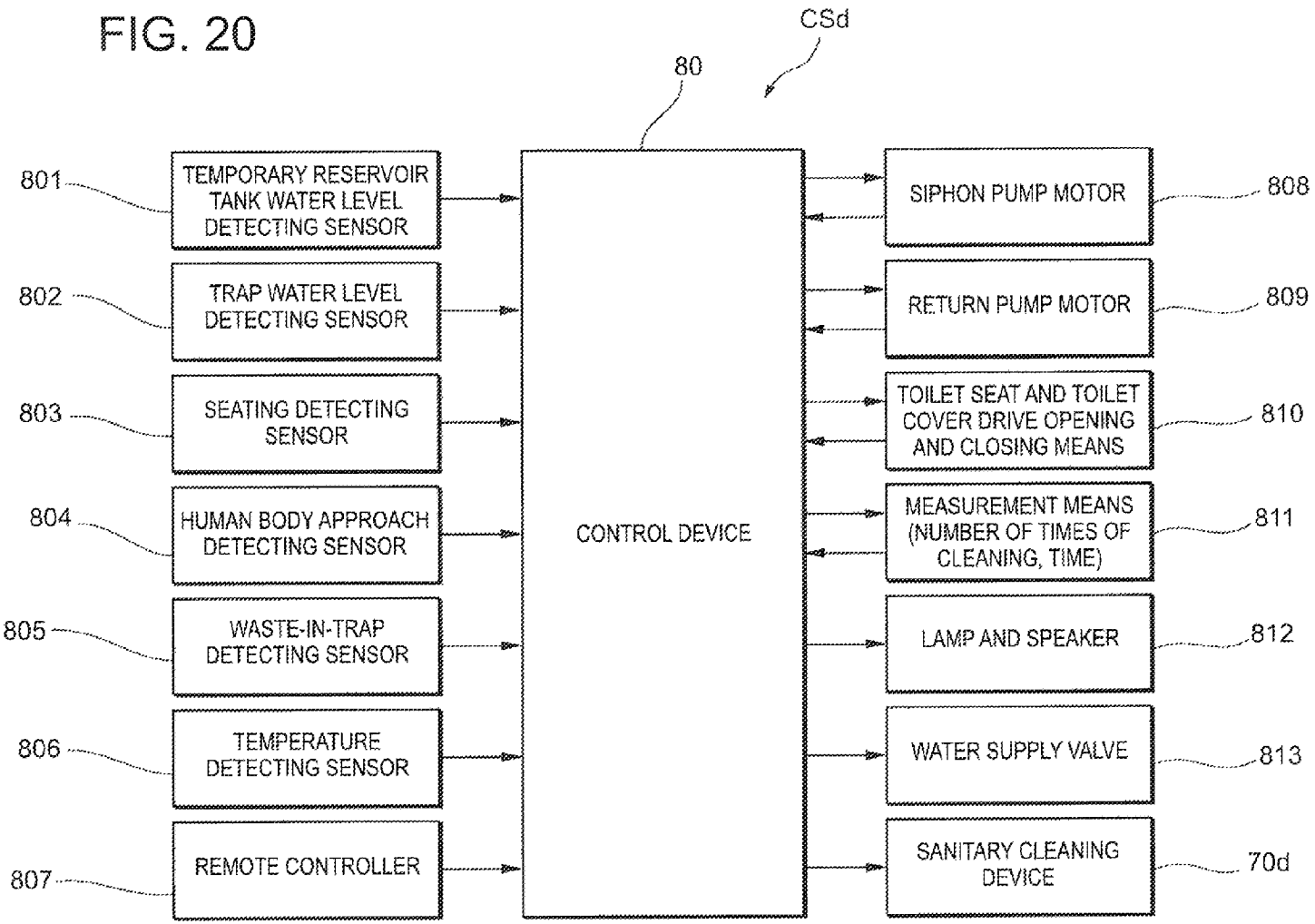
FIG. 20 is a block configuration diagram illustrating a control configuration of the flush toilet device according to the second embodiment of the present invention.

Next, a control configuration of the flush toilet device CSd will be described with reference to FIG. 20. FIG. 20 is a block diagram illustrating a control configuration of the flush toilet device CSd. As shown in FIG. 20, the flush toilet device CSd includes a control device 80 (control means), temporary reservoir tank water level detecting means 801, a trap water level detecting sensor 802, a seating detecting sensor 803, a human body approach detecting sensor 804, a waste-in-trap detecting sensor 805, a temperature detecting sensor 806, a remote controller 807, a siphon pump motor 808, a return pump motor 809, toilet seat cover opening and closing means 810, measurement means 811, a lamp and speaker 812, a water supply valve 813, and a sanitary cleaning device 70*d*.

The temporary reservoir tank water level detecting means 801, the trap water level detecting sensor 802, the seating detecting sensor 803, the human body approach detecting sensor 804, the waste-in-trap detecting sensor 805, the temperature detecting sensor 806, and the remote controller 807 output predetermined measurement signals and instruction signals to the control device 80.

The control device 80 exchanges predetermined measurement signals and control instruction signals with the siphon pump motor 808, the return pump motor 809, the toilet seat cover opening and closing means 810, and the measurement means 811. The control device 80 outputs predetermined control signals to the lamp and speaker 812, the water supply valve 813, and the sanitary cleaning device 70*d*.

Figure 21:
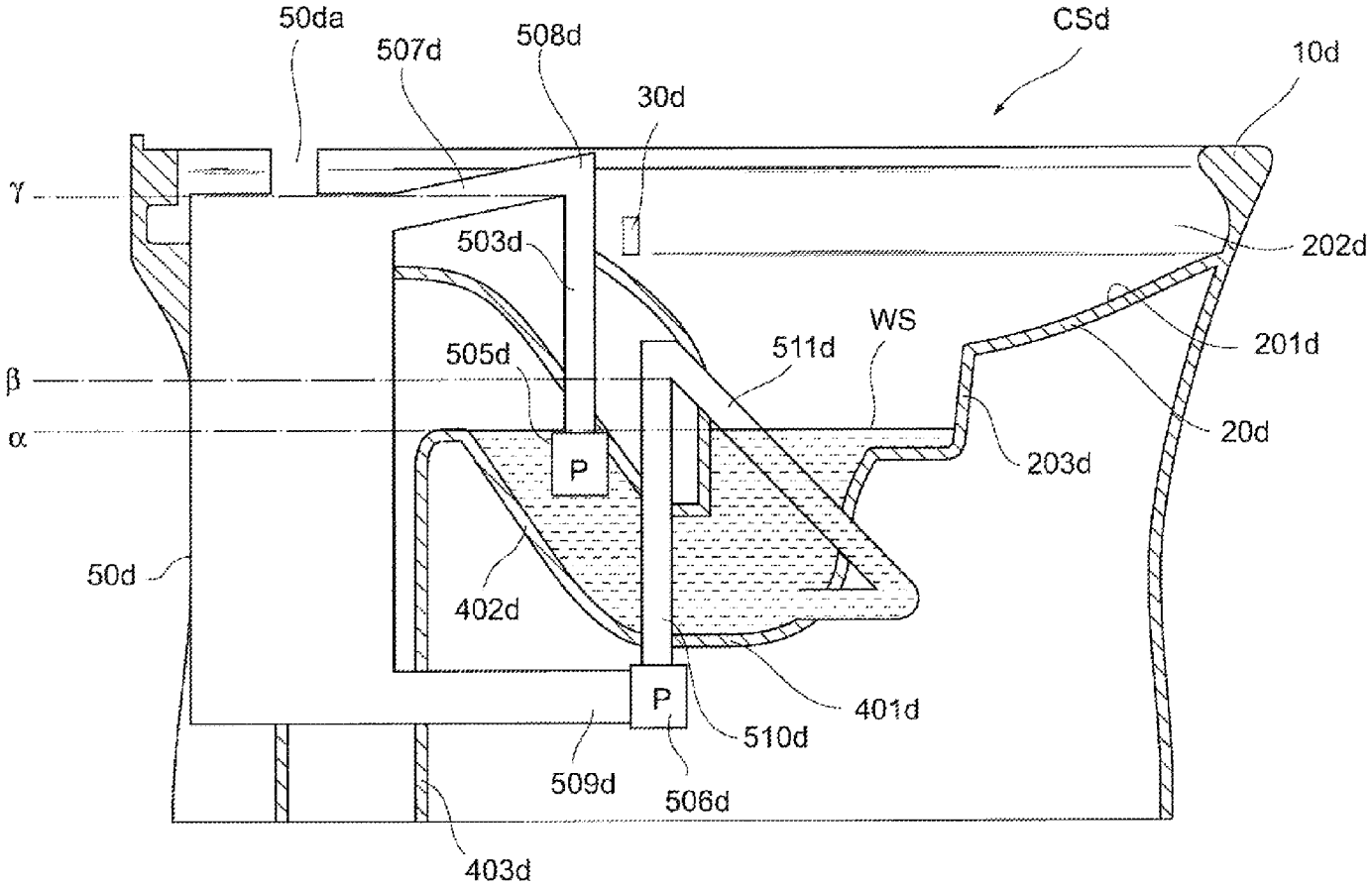
FIG. 21 is a cross-sectional view for schematically illustrating operations of the flush toilet devices shown in FIGS. 15 and 16.

Next, a cleaning operation of the flush toilet device CSd will be described with reference to FIGS. 21, 22, 23, 24, 25, 26, 27, 28, 29, and 30. In a stand-by stage, the retained water WS is reserved up to a vicinity of the upper end of the rising conduit 402*d* of the discharge water trap conduit 40*d* as shown in FIG. 21. In addition, the flush toilet device CSd of this embodiment is configured such that a lower end position β of a cross section of the flow path at a top portion of the return conduit at a part at which the return conduit 510*d* and the return conduit 511*d* are connected to each other is higher than a lower end position α of a cross section of the flow path at a top portion at the uppermost part of the rising conduit 402*d*. In addition, the flush toilet device CSd is configured such that a lower end position γ of a cross section of the flow path at a bent portion 508*d* at the top portion of the siphon conduit is higher than the lower end position β of the cross section of the flow path at the top portion of the return conduit at a part at which the return conduit 510*d* and the return conduit 511*d* are connected to each other. In the stand-by state shown in FIG. 21, a part of the retained water WS also flows into the return conduit 511*d* to the same level as that of the retained water in the discharge water trap conduit 40*d*.

Figure 22:
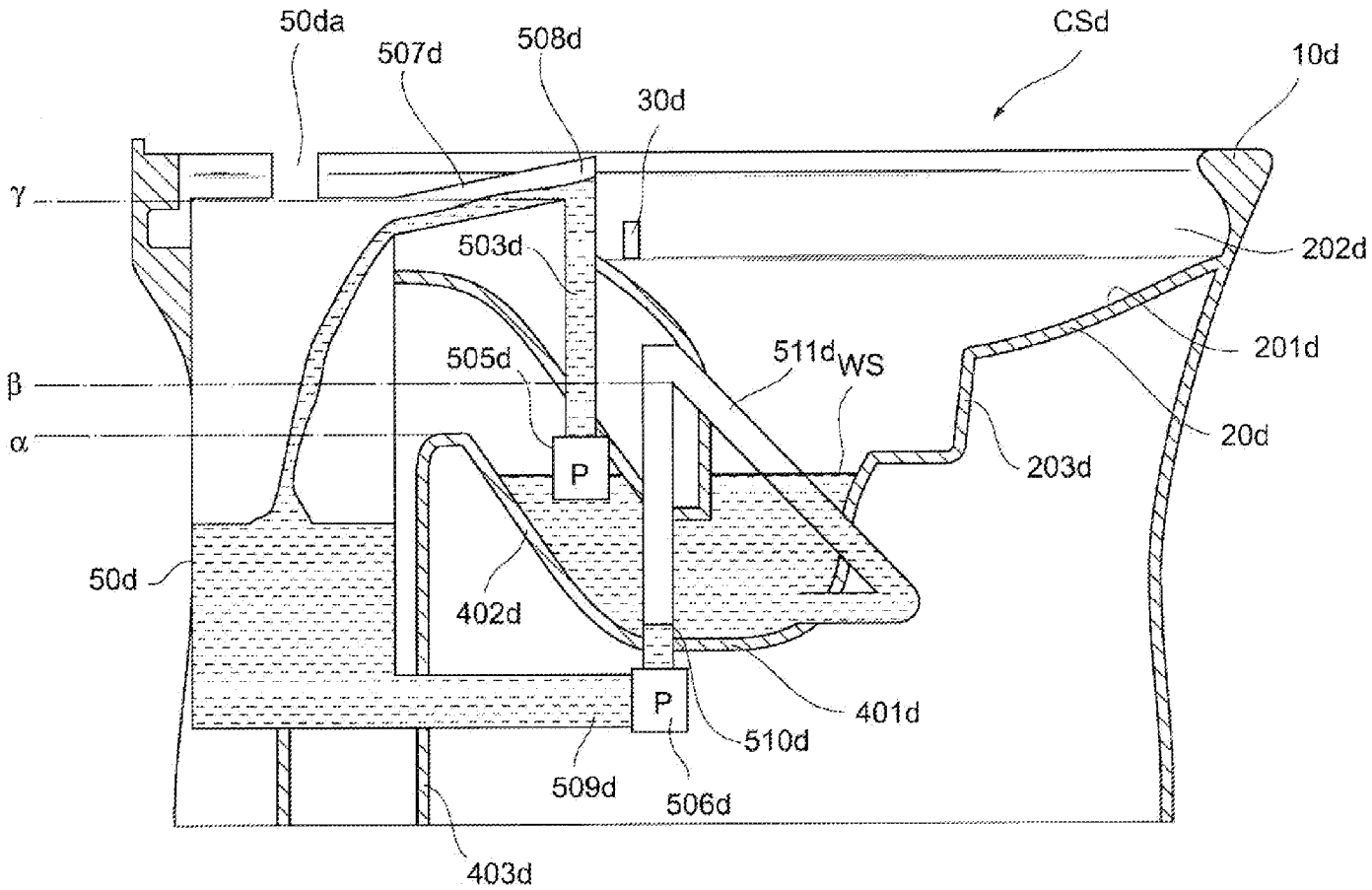
FIG. 22 is a cross-sectional view for schematically illustrating operations of the flush toilet devices shown in FIGS. 15 and 16.

Next, the siphon pump 505*d* is driven to siphon water from the retained water WS and supply the water as siphoned water to the temporary reservoir tank 50*d* as shown in FIG. 22. The siphoned water in the temporary reservoir tank 50*d* flows into the return conduit 509*d*. Since the return conduit 510*d* stands with respect to the return conduit 509*d*, the siphoned water is isolated from the retained water by air in the return conduit 510*d*.

Figure 23:
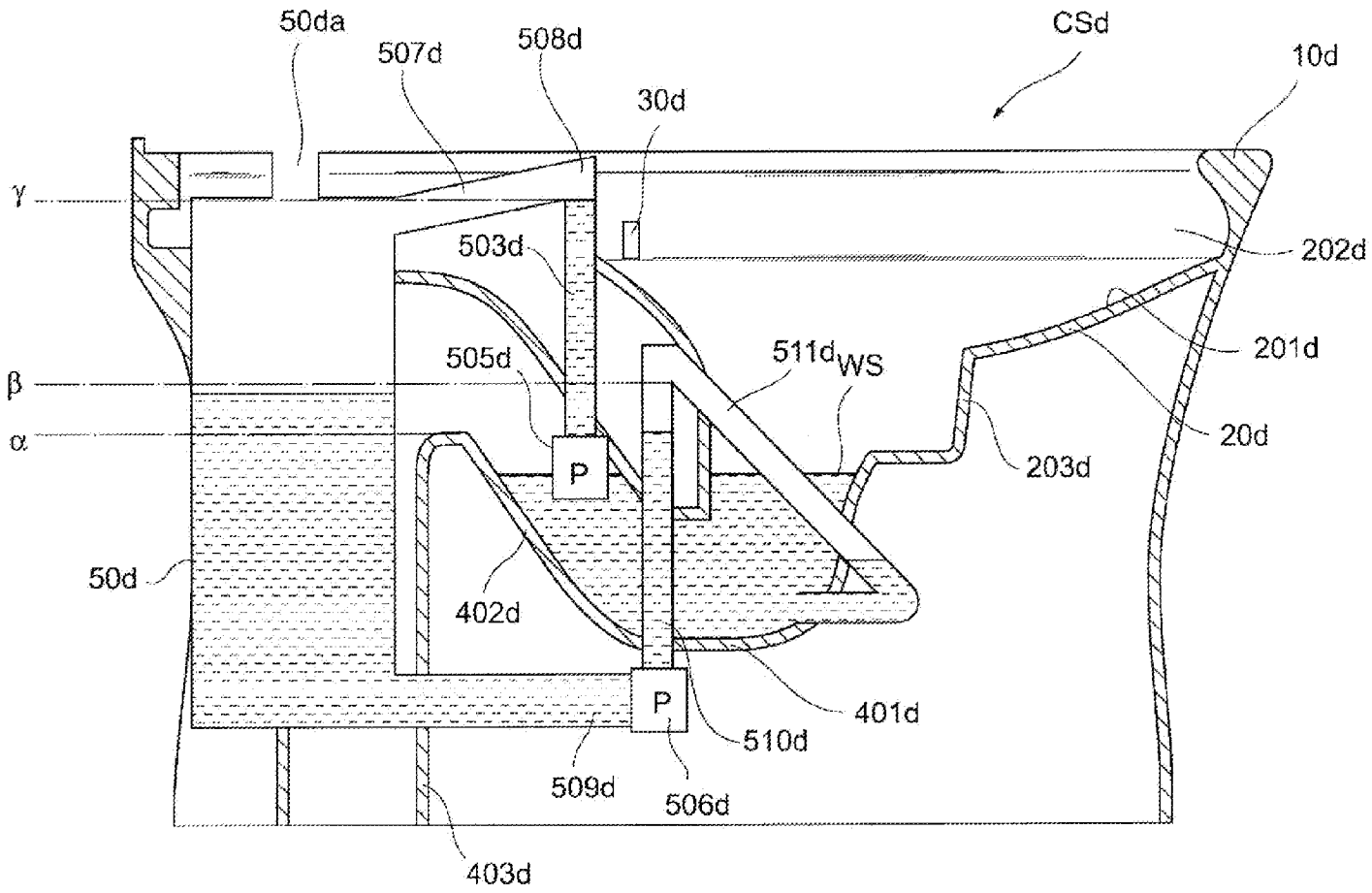
FIG. 23 is a cross-sectional view for schematically illustrating operations of the flush toilet devices shown in FIGS. 15 and 16.

Next, the water level of the retained water WS is lowered, and finally, water cannot be siphoned even if the siphon pump 505*d* is driven as shown in FIG. 23. Since the ventilation hole 50*da* is formed in the temporary reservoir tank 50*d*, the water siphoned in the siphon conduit 503*d* is returned to the discharge water trap conduit 40*d* if the driving of the siphon pump 505*d* is stopped (see FIG. 24).

Figure 24:
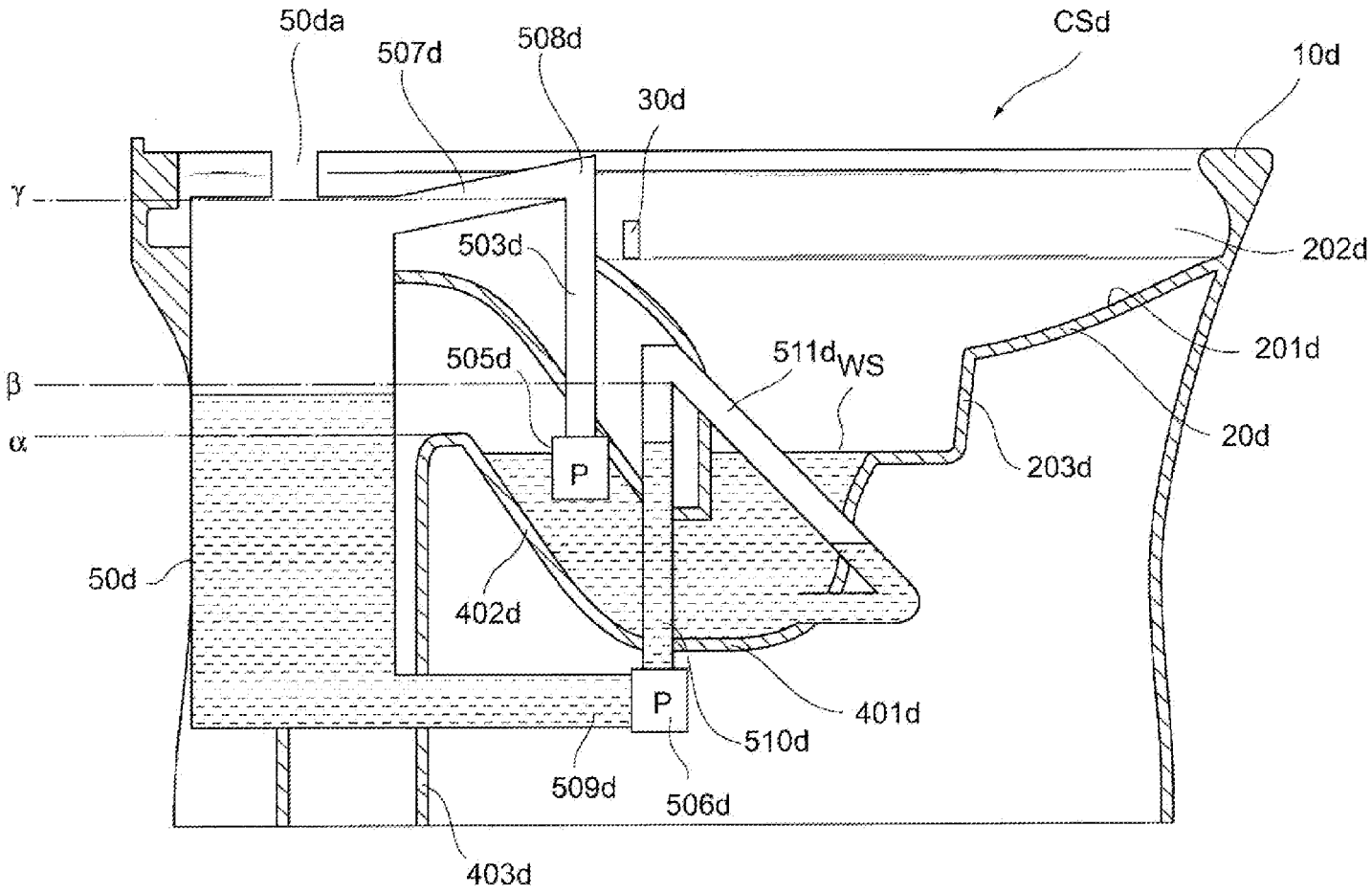
FIG. 24 is a cross-sectional view for schematically illustrating operations of the flush toilet devices shown in FIGS. 15 and 16.
Figure 25:
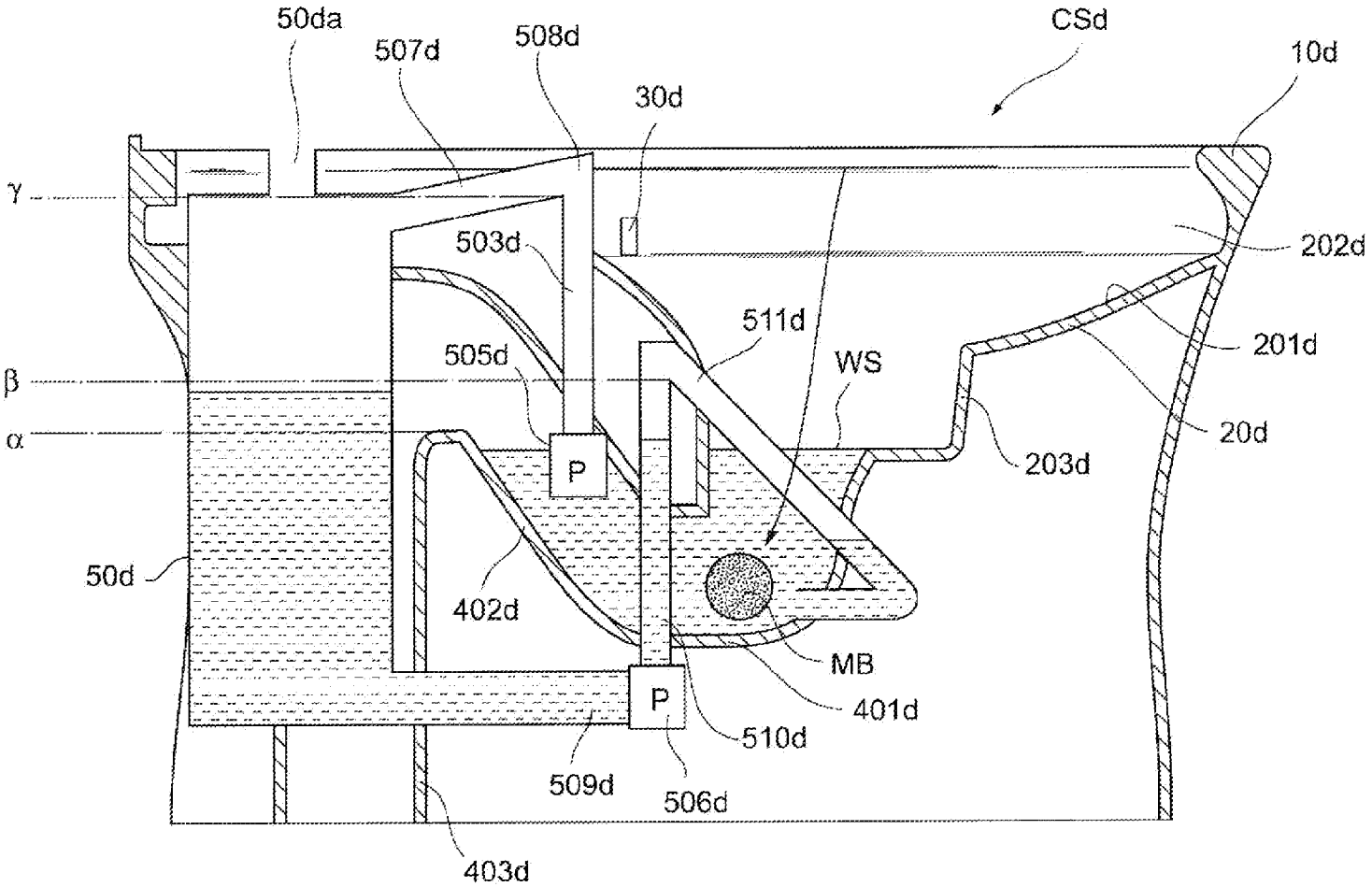
FIG. 25 is a cross-sectional view for schematically illustrating operations of the flush toilet devices shown in FIGS. 15 and 16.
Figure 26:
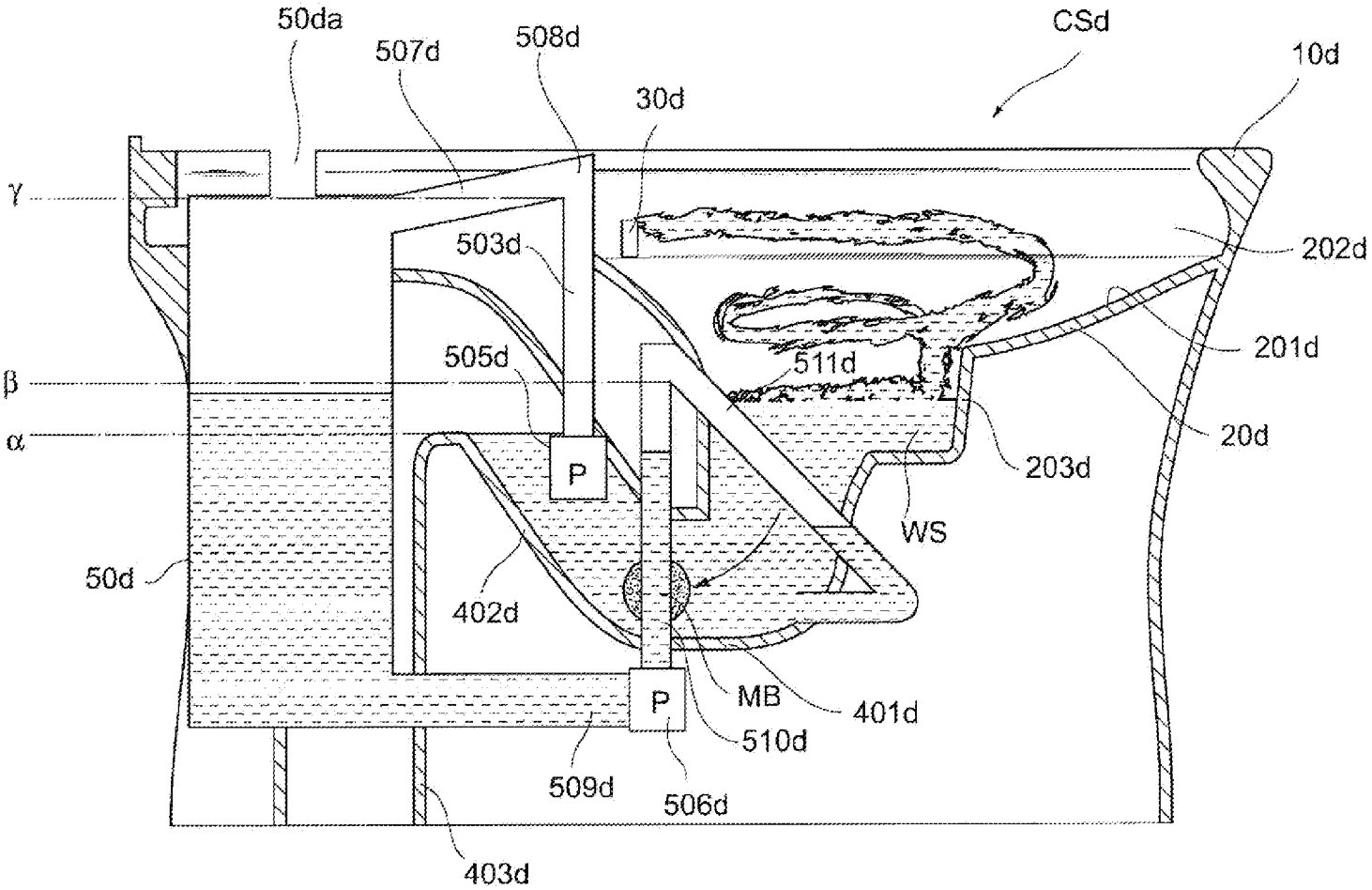
FIG. 26 is a cross-sectional view for schematically illustrating operations of the flush toilet devices shown in FIGS. 15 and 16.

The state shown in FIG. 24 corresponds to a stage in which preparation for receiving waste has been completed. Next, the waste MB enters the retained water WS as shown in FIG. 25. Next, the flush water is supplied from the flush water supply hole 30*d* to the bowl 20*d*, and the waste MB is flushed to the side of the rising conduit 402*d* as shown in FIG. 26.

Figure 27:
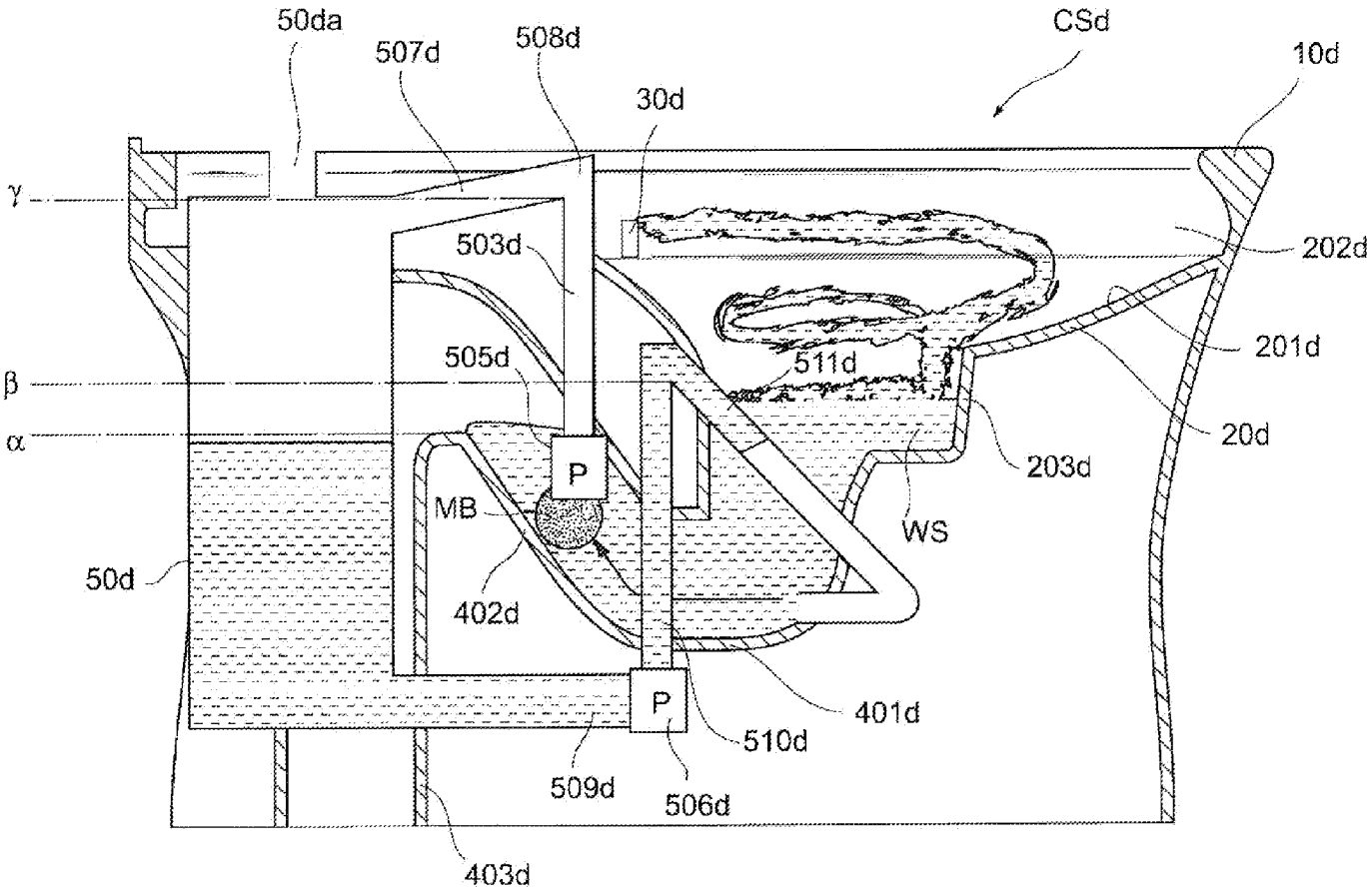
FIG. 27 is a cross-sectional view for schematically illustrating operations of the flush toilet devices shown in FIGS. 15 and 16.

Next, the return pump 506*d* is driven to send the siphoned water in the temporary reservoir tank 50*d* to the side of the discharge water trap conduit 40*d* as shown in FIG. 27. If the return pump 506*d* is driven as described above, the water which has initially entered the return conduit 511*d* in communication with the retained water WS is returned to the discharge water trap conduit 40*d*.

Figure 28:
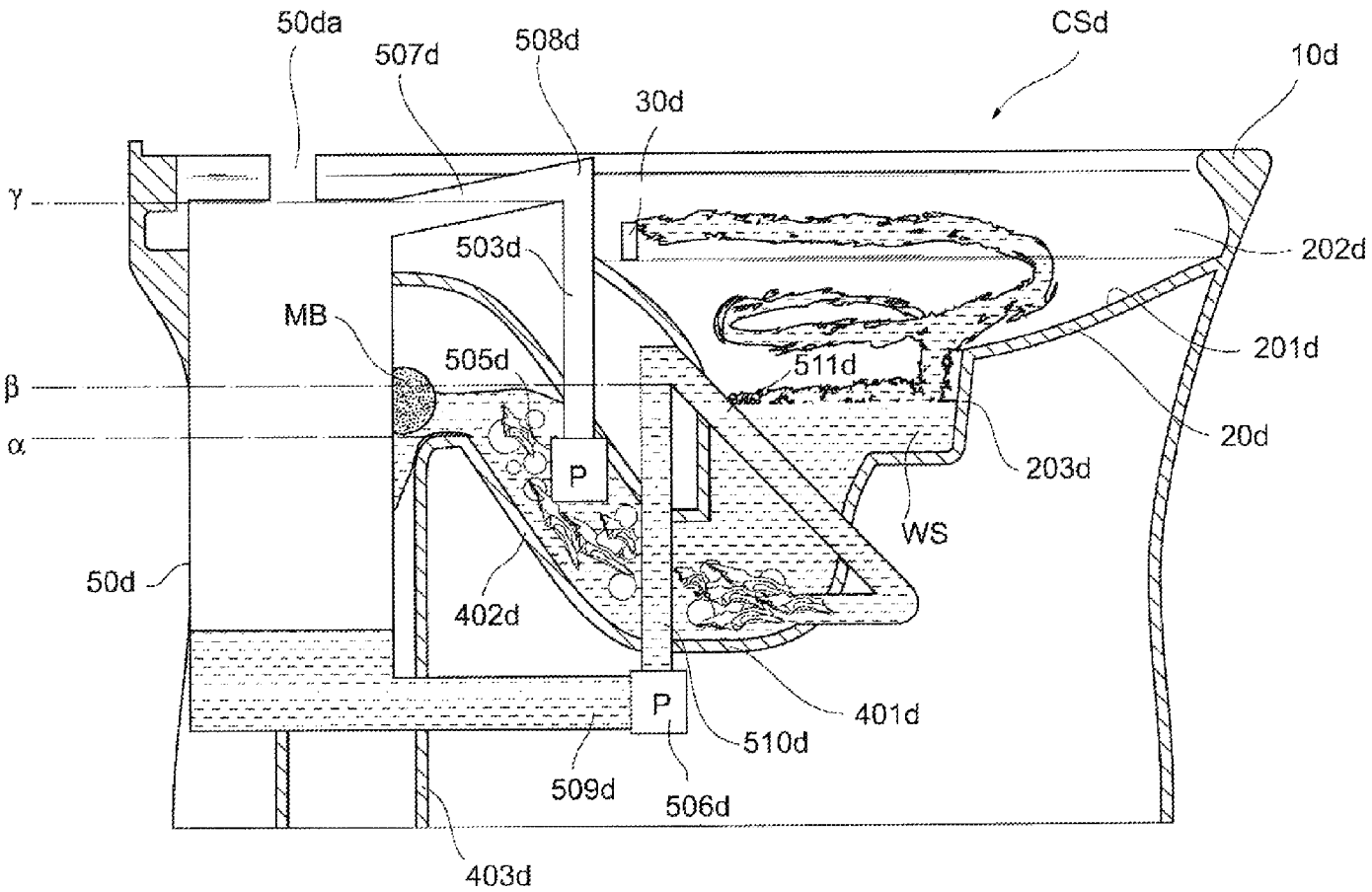
FIG. 28 is a cross-sectional view for schematically illustrating operations of the flush toilet devices shown in FIGS. 15 and 16.

If the driving of the return pump 506*d* is further continued from the state shown in FIG. 27, the air which has isolated the retained water from the siphoned water blows into the discharge water trap conduit 40*d* as shown in FIG. 28. Finally, the siphoned water is sequentially returned to the discharge water trap conduit 40*d* (see FIG. 29), and the siphoned water is completely returned to the discharge water trap conduit 40*d* until the air finally blows off (see FIG. 30).

In addition, since the sanitary cleaning device 70*d* is provided in this embodiment, the retained water can be replenished. If the retained water is replenished as described above, drive control of the siphon pump 505*d* and the return pump 506*d* is facilitated on the assumption that a constant amount of retained water is always present.

Figure 31:
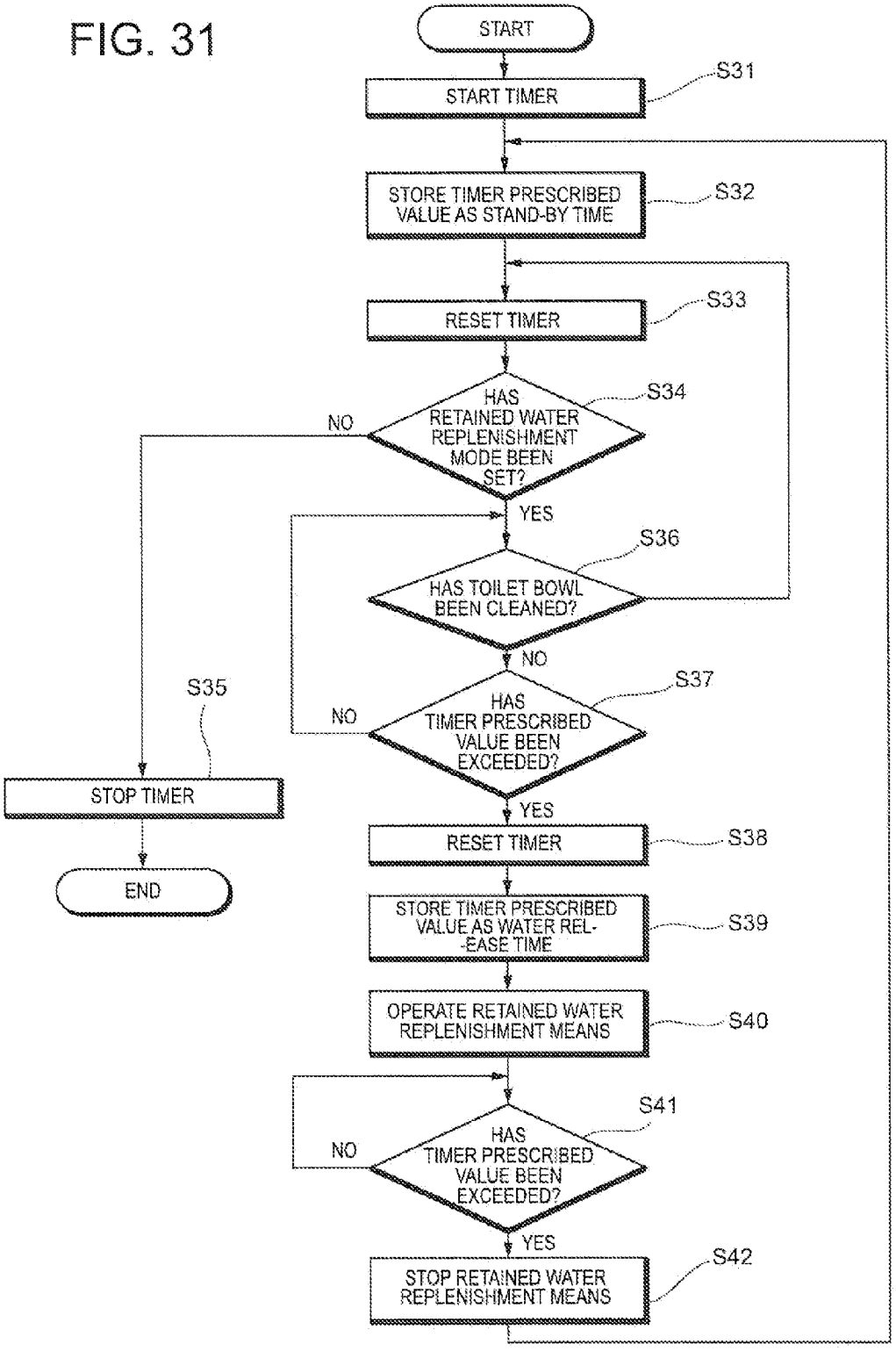
FIG. 31 is a cross-sectional view for schematically illustrating operations of the flush toilet devices shown in FIGS. 15 and 16.

The retained water replenishment control using the sanitary cleaning device 70*d* will be described with reference to FIG. 31. FIG. 31 is a flowchart illustrating the retained water replenishment control. In Step S31, time measurement by the measurement means 811 which is a timer starts. In Step S32 following Step S31, a timer prescribed value is stored as stand-by time. In Step S33 following Step S32, the measurement means 811 which is a timer is reset.

In Step S34 following Step S33, it is determined whether or not a retained water replenishment mode is currently set. The processing proceeds to Step S36 if the retained water replenishment mode is currently set, and the processing proceeds to Step S35 if the retained water replenishment mode is not currently set. In Step S35, the time measurement by the measurement means 811 is stopped.

In Step S36, it is determined whether or not the toilet bowl has been cleaned. The processing returns to Step S33 if the toilet bowl has been cleaned, and the processing proceeds to Step S37 if the toilet bowl has not been cleaned. In Step S37, it is determined whether or not the timer measurement value of the measurement means 811 exceeds the timer prescribed value. The processing returns to Step S36 if the timer measurement value does not exceed the timer prescribed value. The processing proceeds to Step S38 if the timer measurement value exceeds the timer prescribed value.

In Step S38, the measurement means 811 which is the timer is reset. In Step S39 following Step S38, the timer prescribed value is stored as water release time. In Step S40 following Step S39, the sanitary cleaning device 70*d* which is the retained water replenishment means is operated, and the retained water WS is replenished with the flush water from the cleaning nozzle 701.

In Step S41 following Step S40, it is determined whether or not the timer measurement value of the measurement means 811 exceeds the timer prescribed value. The processing in Step S41 is repeated if the timer measurement value does not exceed the timer prescribed value. The processing proceeds to Step S42 if the timer measurement value exceeds the timer prescribed value. In Step S42, the operation of the sanitary cleaning device 70*d* which is the retained water replenishment means is stopped.

As described above, the flush toilet device CSd according to this embodiment is a flush toilet device which temporarily receives waste and discharges the waste with flush water and includes the bowl 20*d* which includes a waste receiving surface 201*d* for temporarily receiving the waste, the flush water supply means (the supply valve 813, the flush water supply hole 30*d*) for supplying the flush water to the bowl 20*d*, the discharge water trap conduit 40*d* which includes the inlet portion 401*d* connected to the lower side of the bowl 20*d*, the rising conduit 402*d* formed so as to extend upward from the inlet portion 401*d*, and the lowering conduit 403*d* formed so as to extend downward from the end of the rising conduit 402*d* and reserves water from the inlet portion 401*d* to at least a part of the rising conduit 402*d* as the retained water WS when the flush toilet device is not in use and forms the sealing water with at least a part of the retained water WS, and the retained water utilizing mechanism which siphons a part of the retained water WS as siphoned water from the discharge water trap conduit 40*d* and returns the siphoned water to the bowl 20*d* or the discharge water trap conduit 40*d*.

The retained water utilizing mechanism includes the temporary reservoir tank 50*d* which temporarily reserves the siphoned water, the siphon pump 505*d* (siphon means) which siphons a part of the retained water WS as siphoned water from the discharge water trap conduit 40*d* to the temporary reservoir tank 50*d*, the return pump 506*d* (return means) which returns the siphoned water which is temporarily reserved in the temporary reservoir tank 50*d* to the bowl 20*d* or the discharge water trap conduit 40*d*, and the sealing breakage preventing means for preventing a level of the sealing water formed by the retained water WS from falling below the level of breaking the sealing even if the siphon pump 505*d* is driven.

The flush toilet device CSd according to this embodiment is provided with the discharge water trap conduit 40*d*, and the discharge water trap conduit 40*d* includes the inlet portion 401*d* which is connected to the lower side of the bowl 20*d*, the rising conduit 402*d* which is formed so as to extend upward from the inlet portion 401*d*, and the lowering conduit 403*d* which is formed so as to extend downward from the end of the rising conduit 402*d*. In addition, the discharge water trap conduit 40*d* reserves water from the inlet portion 401*d* to at least a part of the rising conduit 402*d* as the retained water WS when the flush toilet device is not in use, and forms the sealing water with at least a part of the retained water. The sealing water formed in the discharge water trap conduit 40*d* plays a role in preventing odor from the sewer conduit from entering a toilet room and preventing pests from entering the toilet room. In order to reliably play this role, the depth of the sealing water formed in the discharged water trap conduit 40*d* is set such that the sealing water is not lost due to reasons such as evaporation of the retained water which forms the sealing water.

On the other hand, if attention is paid to the flush toilet device CSd in use, the waste MB temporarily received by the bowl 20*d* falls to the lower side of the bowl 20*d* and is temporarily reserved at an inlet of the discharge water trap conduit 40*d*. The flush water is supplied by the flush water supply means in this state, and the waste MB is flushed to the side of the sewer conduit through the inside of the discharge water trap conduit 40*d*. Accordingly, a part of the retained water WS which forms the sealing water in the discharge water trap conduit 40*d* is used for preventing the sealing water from being lost when the flush toilet device is not in use.

On the other hand, the waste MB received by the bowl 20*d* in use is temporarily reserved near the inlet of the discharge water trap conduit 40*d* and then flushed with the flush water. Since the retained water and the flush water supplied by the flush water supply means on the upstream side (the side of the bowl 20*d*) from the vicinity of the waste contribute to the discharge of the waste MB, the retained water on the downstream side from the vicinity of the waste in the discharge water trap conduit 40*d* does not necessarily contribute to the discharge of the waste. If attention is paid to aforementioned features in the discharge water trap conduit 40*d* of the flush toilet device CSd when the flush toilet device CSd is in use and not in use, it is not always necessary to reserve the retained water for forming the sealing water in the same manner when the flush toilet device CSd is in use and not in use, and there is a room for making arrangement regarding how to retain water when the flush toilet device CSd is in use and not in use.

Thus, according to this embodiment, the retained water utilizing mechanism which siphons a part of the retained water WS as siphoned water from the discharge water trap conduit 40*d* and returns the siphoned water to the bowl 20*d* or the discharge water trap conduit 40*d* is provided. By the retained water utilizing mechanism, the return pump 506*d* is driven after the siphon pump 505*d* is driven when the bowl 20*d* temporarily receives waste and discharges the waste with flush water. Accordingly, the retained water WS is sufficiently retained to some extent in order to reliably form the sealing water when the flush toilet device CSd is not in use, and the retained water which has not been affected by the waste is siphoned and reserved as the siphoned water in the temporary reservoir tank 50*d* by driving the siphon pump 505*d* in advance when the waste is flushed. Since the return pump 506*d* returns the siphoned water to the bowl 20*d* or the discharge water trap conduit 40*d*, it is possible to cause the siphoned water to contribute to transport of the waste.

Furthermore, according to this embodiment, the sealing breakage preventing means for preventing the water level of the sealing water formed by the retained water from falling below the level of breaking the sealing even if the siphon pump 505*d* is driven is provided. Although the siphon pump 505*d* is for siphoning a part of the retained water and introducing the part of the retained water into the temporary reservoir tank 50*d* as described above, the amount of the retained water differs depending on a type of the flush toilet device CSd. In order to utilize a large amount of retained water, it is necessary to adjust the retained water utilizing mechanism in accordance with the respective flush toilet devices. Particularly, when the siphon pump 505*d* siphons the retained water, it is necessary to avoid the sealing water being lost even for short time. Thus, the level of the sealing water formed by the retained water does not fall below the level of breaking the sealing by providing the sealing breakage preventing means. By providing the sealing breakage preventing means for securing the sealing water regardless of the amount of the siphoned water siphoned by the siphon pump 505*d* as described above, it is possible to reliably secure the sealing water despite a difference in the amounts of retained water depending on models of the flush toilet devices and excessive siphoning of the siphoned water by the siphon pump 505*d*. Accordingly, it is possible to provide a flush toilet device with an enhanced water saving performance by making arrangement for dealing with the retained water in the discharge water trap conduit 40*d*, in which the sealing water is not lost.

In addition, the sealing breakage preventing means is configured to restrict the siphon pump so as not to siphon the siphoned water from the retained water WS if the level of the sealing water formed by the retained water reaches a lower limit level, which is a lower limit value of the level for avoiding the sealing breakage, when the siphon pump 505*d* siphons the siphoned water from the retained water WS.

Since the siphoning of the siphoned water from the retained water by the siphon pump 505*d* is restricted if the retained water is siphoned up to the lower limit of the level for avoiding the sealing breakage, it is possible to reliably avoid the sealing breakage.

In addition, the siphon pump 505*d* is a turbo type pump and is configured to siphon the siphoned water from the retained water WS, and the sealing breakage preventing means restricts the siphon pump 505*d* so as not to siphon siphoned water from the retained water WS by forming an air gap between the turbo type pump and the retained water when the level of the sealing water reaches the lower limit and causing the turbo type pump to suction the air.

By using the turbo type pump as the siphon pump 505*d* and utilizing a feature that water cannot be siphoned when the turbo type pump siphons the air as described above, occurrence of the situation that the sealing water is lost can be reliably avoided. By arranging the turbo type pump so as to suction the air when the level of the sealing water formed by the retained water reaches the lower limit level, the turbo type pump cannot siphon the retained water any more, and it is possible to avoid sealing breakage.

It is also preferable that the temporary reservoir tank 50*d* be configured such that the level of the sealing water does not fall below the lower limit level even if the siphon pump 505*d* siphons an amount of siphoned water, which can be reserved, from the retained water WS.

This preferable mode is configured such that the sealing is not broken even if an amount of siphoned water is siphoned from the retained water WS by limiting the water amount to an amount which can be reserved in the temporary reservoir tank 50*d*, and therefore, it is possible to reliably prevent the water from being excessively siphoned from the retained water WS and reliably avoid sealing breakage.

In addition, the retained water utilizing mechanism includes the siphon conduits 503*d* and 507*d* which connect the discharge water trap conduit 40*d* to the temporary reservoir tank 50*d*, the siphon conduits 503*d* and 507*d* have insulating structures so as not to cause the siphoned water reserved in the temporary reservoir tank 50*d* communicating with the siphoned water remaining in the siphon conduit 503*d* (see FIG. 23), and the retained water utilizing mechanism is configured such that the siphoned water remaining in the siphon conduit 503*d* is returned to the discharge water trap conduit when the siphoning of the siphoned water from the retained water WS by the siphon pump 505*d* is stopped.

Since the retained water utilizing mechanism has the insulating structure for separating the siphoned water reserved in the temporary reservoir tank 50*d* from the siphoned water remaining in the discharge water trap conduit 40*d* and the siphon conduit 503*d* and returns the siphoned water remaining in the siphon conduit 503*d* to the discharge water trap conduit 40*d* when the siphoning from the retained water WS is stopped, as described above, it is possible to more reliably prevent the situation that the sealing water is lost.

In addition, it is also preferable that the return pump 506*d* return siphoned water at the same instantaneous flow rate as the instantaneous flow rate of the siphoned water siphoned to the temporary reservoir tank 50*d* by the siphon pump 505*d* such that the level of the sealing water does not fall below the lower limit level when the siphon pump 505*d* continues siphoning of the siphoned water from the siphon conduits 503*d* and 507*d* to the temporary reservoir tank 50*d*.

With such a configuration, the siphoned water at the same instantaneous flow rate as the instantaneous flow rate of the siphoned water siphoned by the siphon pump 505*d* is returned such that the level of the sealing water does not fall below the lower limit level even when the siphon pump 505*d* continuously siphons from the retained water WS, and therefore, it is possible to more reliably prevent the situation that the sealing water is lost.

According to this embodiment, a circulation route (the siphon conduit 503*d*, the bent portion 508*d*, the siphon conduit 507*d*, the return conduit 504*d*, the return conduit 509*d*, the return conduit 510*d*, and the return conduit 511*d*) which is configured to be able to circulate the siphoned water is provided between the bowl 20*d* or the discharge water trap conduit 40*d* and the temporary reservoir tank 50*d*.

By providing the circulation route, the siphoned water siphoned from the retained water WS in the discharge water trap conduit 40*d* by the siphon pump 505*d* is sent to the temporary reservoir tank 50*d* and returned to the bowl 20*d* or the discharge water trap conduit 40*d* by the return pump 506*d*. Accordingly, the siphoned water can be returned by the return pump 506*d* without being excessively reserved in the temporary reservoir tank 50*d* even if the siphoned water is excessively supplied by the siphon pump 505*d*. For this reason, it is possible to exhibit the performance of the retained water utilizing mechanism without applying unnecessary load on the temporary reservoir tank 50*d*.

In addition, since the siphon pump 505*d* which configures the siphon means and the return pump 506*d* which configures the return means are independently provided, an optimal operation of the siphon pump 505*d* for siphoning the siphoned water from the retained water WS and an optimal operation of the return pump 506*d* for returning the siphoned water from the temporary reservoir tank 50*d* can be combined. Accordingly, it is possible to cause the retained water utilizing mechanism for siphoning a part of the retained water WS from the discharge water trap conduit 40*d* and returning the siphoned water to the bowl 20*d* or the discharge water trap conduit 40*d* to further effectively function.

In addition, the circulation route includes reverse flow preventing means for acting such that water passing through the bowl 20*d* or the discharge water trap conduit 40*d* does not flow back through the return conduits 504*d*, 509*d*, 510*d*, and 511*d* and enter the temporary reservoir tank 50*d* after driving the return pump 506*d*.

Since the return conduits 504*d*, 509*d*, 510*d*, and 511*d* which guide the siphoned water from the temporary reservoir tank 50*d* to the bowl 20*d* or the discharge water trap conduit 40*d* are provided, there is a possibility that the inside of the temporary reservoir tank 50*d* may communicate with the discharge water trap conduit 40*d*. If the inside of the temporary reservoir tank 50*d* communicates with the discharge water trap conduit 40*d*, there is a concern that the water on the side of the discharge water trap conduit 40*d* may flow back into the temporary reservoir tank 50*d* when the water level on the side of the discharge water trap conduit 40*d* becomes higher than the water level in the temporary reservoir tank 50*d*. Thus, the reverse flow of the contaminated water to the temporary reservoir tank 50*d* is reliably prevented by providing the reverse flow preventing means for preventing the water passing through the bowl 20*d* or the discharge water trap conduit 40*d* from flowing back through the return conduits 504*d*, 509*d*, 510*d*, and 511*d*.

The reverse flow preventing means is configured by the return conduit 510*d* as a first return part to which the return conduit is connected while inclining downward from the top portion toward the temporary reservoir tank 50*d* and the return conduit 511*d* as a second return part to which the return conduit is connected while inclining downward from the top portion toward the bowl 20*d* or the discharge water trap conduit 40*d*, the reverse flow preventing means is configured such that the lower end $\beta$ of the cross section of the flow path at the top portion is formed at a higher position than the lower end $\alpha$ of the cross section of the flow path at the top portion of the rising conduit 402*d*, and further, the reserve flow preventing means prevents reverse flow to the temporary reservoir tank 50*d* by introducing air into the bent portion configured by the return conduit 510*d* (first return part) and the return conduit 511*d* (second return part) with the top portion interposed therebetween, after driving the return pump 506*d* (see FIG. 26).

In this embodiment, a part at which the water level rises to the uppermost position corresponds to the top portion of the rising conduit 402*d*. Thus, it is possible to insulate the side of the return conduit 510*d* (first return part) from the side of the return conduit 511*d* (second return part) by the air at the bent portion formed at the top portion of the return conduit by forming the lower end $\beta$ of the cross section of the flow path at the top portion of the return conduit at a higher position than the lower end $\alpha$ of the cross section of the flow path at the top portion of the rising conduit 402*d*. Accordingly, it is possible to reliably prevent the reverse flow of contaminated water to the temporary reservoir tank 50*d*.

Figure 29:
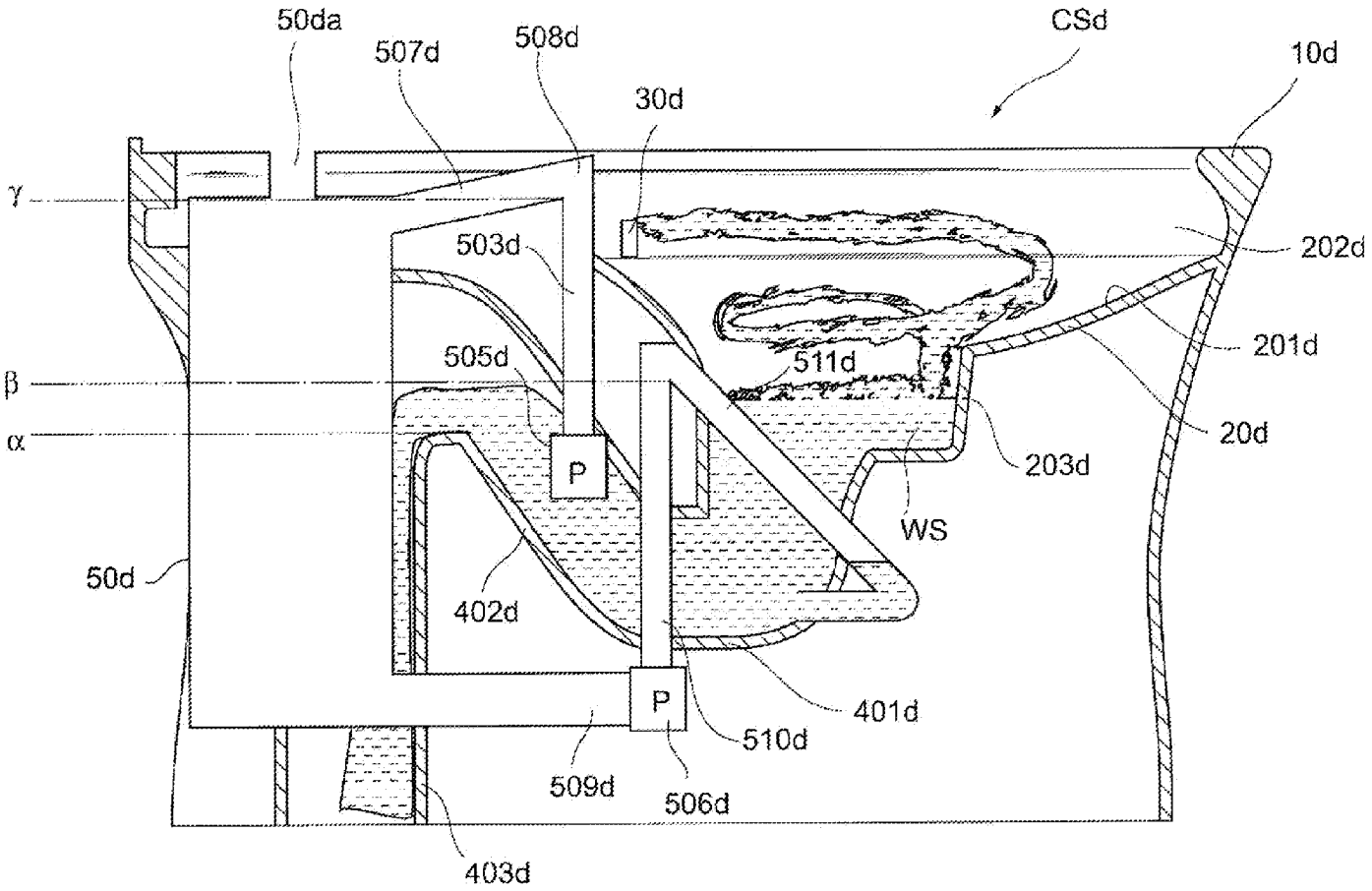
FIG. 29 is a cross-sectional view for schematically illustrating operations of the flush toilet devices shown in FIGS. 15 and 16.
Figure 30:
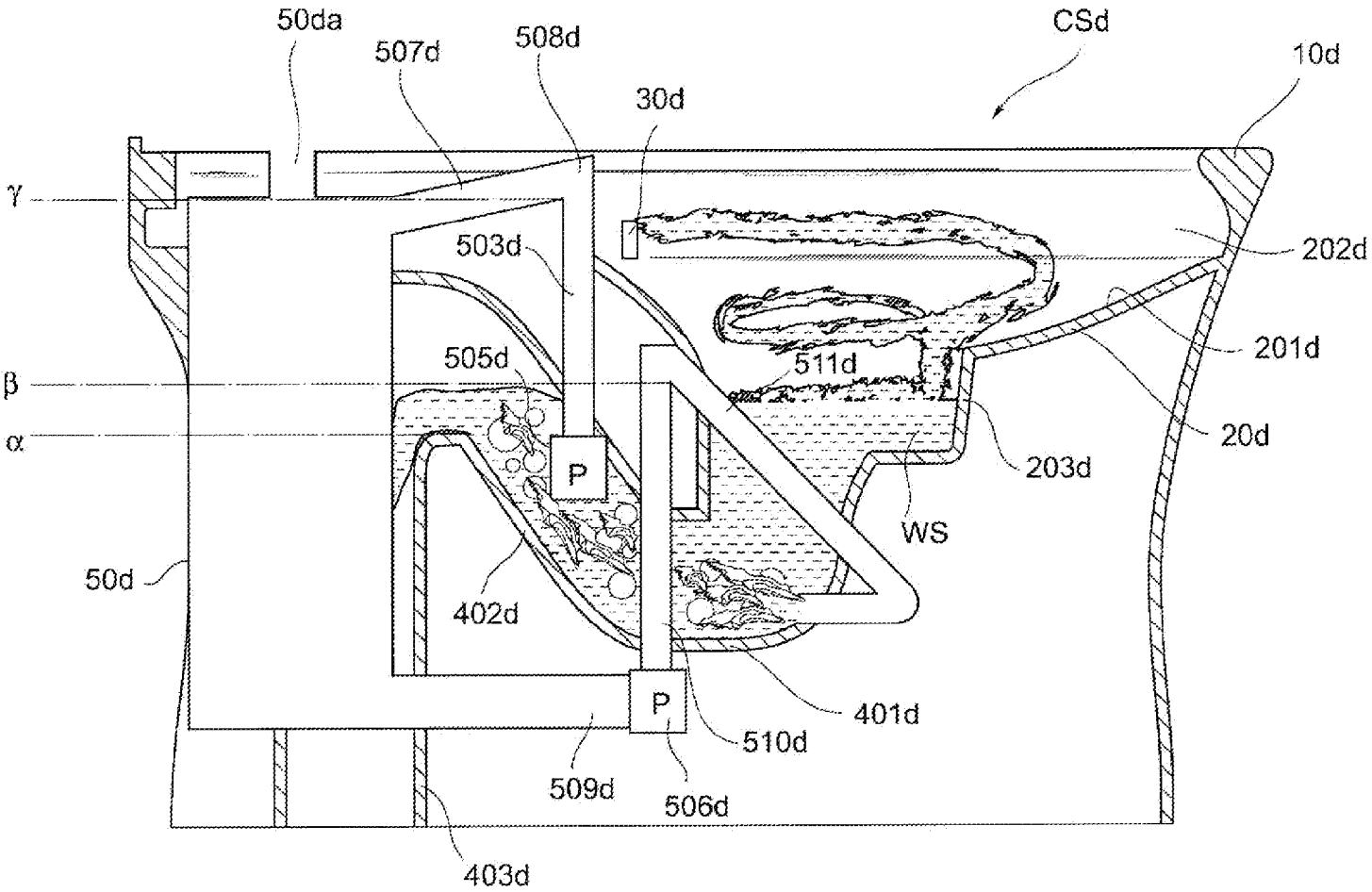
FIG. 30 is a cross-sectional view for schematically illustrating operations of the flush toilet devices shown in FIGS. 15 and 16.

In addition, according to this embodiment, driving of the return pump 506*d* is continued even after the water passing through the return conduit from the temporary reservoir tank 50*d* is discharged, and the air is introduced into the bent portion by the continuous driving of the return pump 506*d* in order to exhibit the effect of the reverse flow preventing means (see FIGS. 29 and 30).

Since the air is introduced into the bent portion by continuing the driving of the return pump 506*d* even after the water passing through the return conduit from the temporary reservoir tank 50*d* is discharged, it is possible to configure the reverse flow preventing means without additionally providing means for introducing the air into the bent portion. Accordingly, it is possible to downsize the flush toilet device CSd with a simple configuration.

The reverse flow to the temporary reservoir tank 50*d* is prevented by returning the water in the return conduit 511*d* (second return part), the air in the bent portion, and the siphoned water in the return conduit 510*d* (first return part) in this order by pushing and flushing the siphoned water reserved in the temporary reservoir tank 50*d* when the siphoned water is returned from the temporary reservoir tank

50*d* to the bowl 20*d* or the discharge water trap conduit 40*d* in order to exhibit the effect of the reverse flow preventing means.

By pushing and flushing the air so as to be interposed between the water in the return conduit 511*d* (second return part) and the siphoned water in the return conduit 510*d* (first return part) as described above, the air as compressible fluid is returned to the discharge water trap conduit 40*d* in the compressed state. For this reason, it is possible to push and flush the waste to the downstream side by the pressurized air and enhance a waste discharge effect.

In addition, according to this embodiment, the siphon pump 505*d* is for siphoning a part of the retained water WS as siphoned water from the rising conduit 402*d* and is configured to siphon the siphoned water while suppressing suctioning of waste which is present in the rising conduit 402*d*.

A part of the retained water WS is siphoned as the siphoned water in this embodiment, and therefore, there is a concern that the siphon conduit 503*d* may become blocked or the inside of the temporary reservoir tank 50*d* may become contaminated if the waste in the retained water is siphoned together with the water. Thus, it is possible to prevent the blockage of the siphon conduit 503*d* in advance and also suppress waste entering the temporary reservoir tank 50*d* by configuring the siphon means so as not to suction the waste which is present in the rising conduit 402*d*.

For the suppression, the siphoned water is siphoned from the rising conduit 402*d* at a higher position than the height at which the sealing water can be formed by the retained water in the discharge water trap conduit 40*d* in this embodiment.

It is also assumed that waste advances through the discharge water trap conduit 40*d* from the side of the bowl 20*d* and invades the rising conduit 402*d*. Thus, it is possible to reliably suppress the siphoning of waste with the configuration in which the siphoned water is siphoned from the retained water at a higher position than the height at which the sealing water can be formed in the rising conduit 402*d*.

In addition, the siphon conduit 503*d* is connected to the inside of the discharge water trap conduit 40*d* from a side so as to penetrate through the plane PLa, along which the discharge water trap conduit 40*d* is bent, and communicates the discharge water trap conduit 40*d* with the temporary reservoir tank 50*d*, and the siphoned water is siphoned through the siphon conduit 503*d* from the discharge water trap conduit 40*d* to the temporary reservoir tank 50*d*.

In this embodiment, the discharge water trap conduit 40*d* is formed from the upstream side to the downstream side while bent to form the sealing water. At a part where the plane PLa along which the discharge water trap conduit is bent intersects the discharge water trap conduit 40*d*, the water flowing through the discharge water trap conduit 40*d* tends to be directed more strongly to the outside. Thus, the siphon conduit 503*d* is configured so as not to easily siphon waste when the siphoned water is siphoned from the retained water, by providing the siphon conduit 503*d* so as to be connected to the inside of the discharge water trap conduit 40*d* from a side so as to penetrate through the plane PLa along which the discharge water trap conduit 40*d* is bent (see FIG. 18).

In addition, the siphon conduit 503*d* is connected to the discharge water trap conduit 40*d* such that the siphon conduit 503*d* immediately after branching from the discharge water trap conduit 40*d* is directed to the upstream side of the discharge water trap conduit 40*d* (see FIG. 19).

The waste flushed through the discharge water trap conduit 40*d* is flushed from the upstream side, namely the side of the bowl 20*d* in the discharge water trap conduit 40*d* to the downstream side. Thus, it is possible to direct the direction, in which the siphon conduit 503*d* siphons the siphoned water, to an opposite direction to the direction in which the waste is flushed and to thereby more reliably suppress the siphoning of the waste, by connecting the siphon conduit 503*d* to the discharge water trap conduit 40*d* so as to face the upstream side.

In addition, according to this embodiment, an invasion suppressor for suppressing the flush water, which is supplied to the bowl 20*d* by the flush water supply means, being siphoned into the temporary reservoir tank 50*d* when the flush water is discharged and flows through the discharge water trap conduit 40*d* after the bowl 20*d* receives waste is provided.

Since the water to be siphoned and utilized by the siphon pump 505*d* corresponds to a part of the retained water WS in this embodiment, siphoning of the flush water for flushing the waste corresponds to abnormal invasion which is not originally assumed. If such abnormal invasion of the flush water is ignored, there is a concern of waste invasion and lowering of the water saving performance. Thus, the invasion of the ordinary flush water into the retained water utilizing mechanism is suppressed by providing the invasion suppressor.

Specifically, the invasion suppressor is configured by setting flow path resistance of the siphon conduit 503*d* from the discharge water trap conduit 40*d* to the temporary reservoir tank 50*d* to be higher than the flow path resistance of the discharge water trap conduit 40*d*. With such a simple configuration in which the flow path resistance of the siphon conduit 503*d* is set to be higher than the flow path resistance of the discharge water trap conduit 40*d*, it is possible to suppress the abnormal invasion of the ordinary flush water into the siphon conduit 503*d*.

In addition, the lower end $\gamma$ of the cross section of the flow path at the top portion of the siphon conduit 503*d* is formed at a higher position than the lower end $\alpha$ of the cross section of the flow path at the top portion of the rising conduit 402*d*. With such a configuration, it is possible to reliably suppress the flush water flowing into the temporary reservoir tank 50*d* even if the ordinary flush water is siphoned into the siphon conduit 503*d*.

In the siphon conduit, the bent portion 508*d* is formed by the siphon conduit 503*d* (first siphon part) and the siphon conduit 507*d* (second siphon part) with the top portion interposed therebetween. By forming the bent portion 508*d* at the top portion as described above, it is possible to further enhance the flow path resistance and reliably suppress the flow of the flush water into the temporary reservoir tank 50*d*.

In addition, the top portion is provided at the substantially same height as the height of the flush water supply hole 30*d* formed in the rim portion 202*d* of the bowl 20*d*, and the siphon conduit 503*d* (first siphon part) is formed as a part which is inclined downward and connected to the discharge water trap conduit 40*d* from the top portion while the siphon conduit 507*d* (second siphon part) is formed as a part which is inclined downward and connected to the temporary reservoir tank 50*d* from the top portion.

Since the siphon conduit 503*d* (first siphon part) is formed as a part which is inclined downward and connected to the discharge water trap conduit while the siphon conduit 507*d* (second siphon part) is formed as a part which is inclined downward and connected to the temporary reservoir tank 50*d* as described above, it is possible to enhance the flow path resistance by setting a steep angle as the angle of the bent portion 508*d*. Furthermore, it is possible to lower the position of the temporary reservoir tank 50*d* by setting the height of the top portion to be the same height as the rim portion 202*d* and to thereby enhance a degree of freedom in arrangement.

In addition, according to this embodiment, it is possible to further enhance the flow path resistance of the siphon conduit 503*d* by providing the siphon pump 505*d* in the course of the siphon conduit 503*d* and reliably suppress the siphoning of the flush water.

In addition, the siphon pump 505*d* is configured such that the driving of the siphon pump 505*d* is stopped after elapse of a predetermined time after start of the driving. By limiting the driving of the siphon pump 505*d* to be within the predetermined time as described above, it is possible to reliably set the amount of water to be siphoned into the temporary reservoir tank 50*d* within a predetermined amount. Accordingly, it is possible to reliably prevent the retained water in the discharge water trap conduit 40*d* from being unnecessarily siphoned and prevent the sealing water formed by the retained water from breaking.

In addition, the sanitary cleaning device 70*d* is provided as sealing water adding means for supplying water separately from the retained water such that the level of the sealing water does not fall below the lower limit value of the level at which the sealing breaks by the driving of the siphon pump 505*d*.

Since water is supplied separately from the retained water by the sanitary cleaning device 70*d* as the sealing water adding means, it is possible to recover a predetermined amount of retained water even if the amount of water decreases due to evaporation of the retained water. Accordingly, it is possible to reliably avoid occurrence of the situation that the retained water is excessively siphoned and the sealing water is lost even if the drive time of the siphon pump 505*d* is set to a predetermined time.

In addition, since water is supplied by the sanitary cleaning device 70*d* separately from the retained water, it is possible to additionally pour water for preventing sealing breakage without newly adding a device for supplying water.

The above description was given of the embodiments of the present invention with reference to the specific examples. However, the present invention is not limited to the specific examples. That is, appropriate design modifications added to the specific examples by those skilled in the art are also within a scope of the present invention as long as the modifications have the features of the present invention. For example, respective components provided in the aforementioned respective specific examples, arrangement thereof, materials, conditions, shapes, sizes, and the like are not limited to those in the examples and can be appropriately modified. In addition, the respective components provided in the aforementioned respective embodiments can be combined if technically possible, and the combinations are also within the scope of the present invention as long as the combinations include the features of the present invention.

DESCRIPTION OF REFERENCE NUMERALS

1: opening and closing valve
2: opening and closing valve
10: toilet bowl main body
20: bowl
30: flush water supply hole
40: discharge water trap conduit
50: pump
50*b*: pump
201: waste receiving surface
202: rim portion
203: bowl outlet portion
301: water supply valve
401: inlet portion
402: rising conduit
403: lowering conduit
501: temporary reservoir tank
501*b*: temporary reservoir tank
502: piston
502*b*: piston
503: temporary reservoir flow path
503*a*: temporary reservoir flow path
503*b*: siphon flow path
504*b*: return flow path
601: human body detecting sensor
602: operation panel
603: timer
604: toilet cover opening and closing mechanism
A: timer
a1: prescribed time
B: timer
CS: flush toilet device
CSa: flush toilet device
CSb: flush toilet device
MB: waste
WP: siphoned water
WS: retained water
CSd: flush toilet device
10*d*: toilet bowl main body
20*d*: bowl
30*d*: flush water supply hole
40*d*: discharge water trap conduit
50*d*: temporary reservoir tank
70*d*: sanitary cleaning device
201*d*: waste receiving surface
202*d*: rim portion
203*d*: bowl outlet portion
401*d*: inlet portion
402*d*: rising conduit
403*d*: lowering conduit
404*d*: suctioning port
503*d*: siphon conduit (first siphon part)
504*d*: return conduit
505*d*: siphon pump
506*d*: return pump
507*d*: siphon conduit (second siphon part)
508*d*: bent portion
509*d*: return conduit
510*d*: return conduit (first return part)
511*d*: return conduit (second return part)
701*d*: cleaning nozzl

The invention claimed is:

1. A flush toilet device which temporarily receives waste and discharges the waste with flush water, comprising:

a bowl which includes a waste receiving surface for temporarily receiving waste;

a flush water supplier that supplies flush water to the bowl;

a discharge water trap conduit which is connected to a lower side of the bowl, reserves water as retained water when the flush toilet device is not in use, and forms sealing water with at least a part of the retained water; and a retained water utilizing mechanism which siphons a part of the retained water from the bowl or the discharge water trap conduit as siphoned water and returns the siphoned water to the bowl portion or the discharge water trap conduit, wherein the retained water utilizing mechanism includes:

a temporary reservoir tank which temporarily reserves the siphoned water, a siphoner that siphons a part of the retained water from the bowl or the discharge trap conduit to the temporary reservoir tank as the siphoned water, a returner that returns the siphoned water which is temporarily reserved in the temporary reservoir tank to the bowl or the discharge water trap conduit, and a controller that controls behaviors of the siphoner and the returner, and wherein the controller drives the siphoner before the waste is transported from at least the discharge water trap conduit with the flush water supplied from the flush water supplier when the bowl discharges the waste with the flush water after temporarily receiving the waste and then drives the returner before the supply of the flush water from the flush water supplier is completed.

2. The flush toilet device according to claim 1, wherein an amount of the retained water siphoned by the siphoner from the discharge water trap conduit to the temporary reservoir tank is an amount with which the sealing water formed in the discharge water trap conduit does not break.

3. The flush toilet device according to claim 2, comprising:

a detector that detects a state immediately before use, namely before a user egests the waste in the bowl, wherein the controller drives the siphoner in response to detection of the state immediately before use by the detector.

4. The flush toilet device according to claim 3, comprising:

a toilet cover which covers the bowl; and a toilet cover driver that drives the toilet cover, wherein the controller controls the toilet cover driver so as to maintain a state in which the toilet cover is closed until the siphoner is driven and open the toilet cover after the siphoner is driven.

5. The flush toilet device according to claim 2, wherein the controller drives the returner based on the supply of the flush water from the flush water supplier.

6. The flush toilet device according to claim 5, wherein the controller drives the returner after the supply of the flush water from the flush water supplier is started.

7. The flush toilet device according to claim 6, wherein the siphoned water sent back from the temporary reservoir tank to the bowl or the discharge water trap conduit is supplied along a waste discharge direction in the bowl or the discharge water trap conduit.

8. The flush toilet device according to claim 3, wherein the detector includes a human body detecting sensor which detects that a user reaches a position corresponding to the state immediately before use, and wherein the controller drives the siphoner in response to detection of a user by the human detecting sensor and then drives the returner in response to a state in which the human body detecting sensor does not detect the user.

9. The flush toilet device according to claim 3, wherein the controller drives the siphoner in response to detection of a state immediately before use by the detector and then drives the returner in response to elapse of a predetermined time.

10. The flush toilet device according to claim 2, wherein the controller stops driving of the siphoner after elapse of a predetermined time after start of the driving.

11. The flush toilet device according to claim 10, wherein the retained water utilizing mechanism includes a sealing water adder that supplies water separately from the retained water such that a level of the sealing water by the driving of the siphoner does not fall below a lower limit value of a level at which sealing breaks.

12. The flush toilet device according to claim 1, comprising:

a sealing breakage preventer that prevents a level of the sealing water formed by the retained water from falling below a level at which sealing breaks even if the siphoner is driven.

13. The flush toilet device according to claim 12, wherein the sealing breakage preventer is configured to restrict the siphoner so as not to siphon the siphoned water from the retained water if the level of the sealing water formed by the retained water reaches a lower limit level as a lower limit value of the level for avoiding the sealing breakage when the siphoner siphons the siphoned water from the retained water.

14. The flush toilet device according to claim 13, wherein the siphoner is configured to siphon the siphoned water from the retained water by a turbo type pump, and wherein the sealing breakage preventer restricts the siphoner so as not to siphon the siphoned water from the retained water by forming an air gap between the turbo type pump and the retained water and causing the turbo type pump to suction the air.

15. The flush toilet device according to claim 13, wherein the retained water utilizing mechanism includes a siphon conduit which connects the discharge water trap conduit to the temporary reservoir tank, wherein the siphon conduit has an insulating structure such that the siphoned water reserved in the temporary reservoir tank does not communicate with the siphoned water remaining in the siphon conduit, and wherein the retained water utilizing mechanism is configured such that the siphoned water remaining in the siphon conduit is returned to the discharge water trap conduit when the siphoning of the siphoned water from the retained water by the siphoner is stopped.

16. The flush toilet device according to claim 12, wherein when the siphoner continuously siphons the siphoned water into the temporary reservoir tank, the returner returns siphoned water at a same instantaneous flow rate as an instantaneous flow rate of the siphoned water to be siphoned to the temporary reservoir tank by the siphoner such that the level of the sealing water does not fall below a lower limit value level which is a lower limit value of a level for avoiding sealing breakage.

17. The flush toilet device according to claim 1, comprising:

a circulation route configured to be able to circulate the siphoned water between the bowl or the discharge water trap conduit and the temporary reservoir tank.

18. The flush toilet device according to claim 17, wherein the siphoner is configured by a siphon pump which siphons the siphoned water from the retained water, wherein the returner is configured by a return pump which returns the siphoned water to the bowl or the discharge water trap conduit, and wherein the siphon pump and the return pump are separately provided.

19. The flush toilet device according to claim 18, wherein the circulation route includes a siphon conduit which guides the siphoned water from the retained water to the temporary reservoir tank, a return conduit which guides the siphoned water from the temporary reservoir tank to the bowl or the discharge water trap conduit, and a reverse flow preventer that acts such that water passing through the bowl or the discharge water trap conduit does not flow back through the return conduit and enter the temporary reservoir tank after the return pump is driven.

20. The flush toilet device according to claim 19, wherein the discharge water trap conduit includes an inlet portion which is connected to a lower side of the bowl, a rising conduit which is formed so as to extend upward from the inlet portion, and a lowering conduit which is formed so as to extend downward from an end of the rising conduit, wherein the reverse flow preventer is configured by a first return part to which the return conduit is connected while inclining downward from a top portion thereof toward the temporary reservoir tank and a second return part to which the return conduit is connected while inclining downward from the top portion toward the bowl or the discharge water trap conduit, and is configured such that a lower end of a cross section of a flow path at the top portion is formed at a higher position than a lower end of a cross section of a flow path at a top portion of the rising conduit, and wherein reverse flow to the temporary reservoir tank is prevented by introducing air to a bent portion configured by the first return part and the second return part with the top portion interposed therebetween after the return pump is driven.

21. The flush toilet device according to claim 20, wherein the reverse flow preventer continuously drives the return pump even after water passing through the return conduit is discharged from the temporary reservoir tank and introduces the air to the bent portion by the continuous driving of the return pump.

22. The flush toilet device according to claim 1, wherein the discharge water trap conduit includes an inlet portion which is connected to a lower side of the bowl, a rising conduit which is formed so as to extend upward from the inlet portion, and a lowering conduit which is formed so as to extend downward from an end of the rising conduit, and wherein the siphoner is for siphoning a part of the retained water from the rising conduit as siphoned water and siphons the siphoned water while suppressing suctioning of waste which is present in the rising conduit.

23. The flush toilet device according to claim 22, wherein the siphoner siphons the siphoned water from the rising conduit at a higher portion than a level at which the retained water is able to form the sealing water in the discharge water trap conduit.

24. The flush toilet device according to claim 23, wherein the retained water utilizing mechanism includes a siphon conduit which is connected to an inside of the discharge water trap conduit from a side so as to penetrate through a plane along which the discharge water trap conduit is bent and causes the discharge water trap conduit to communicate with the temporary reservoir tank, and the siphoned water is siphoned through the siphon conduit from the discharge water trap conduit to the temporary reservoir tank.

25. The flush toilet device according to claim 1, comprising:

an invasion suppressor that suppresses flush water, which is supplied to the bowl by the flush water supplier, invading the temporary reservoir tank when the flush water is discharged and flows from the discharge water trap conduit after the bowl receives waste.

26. The flush toilet device according to claim 25, wherein the invasion suppressor is configured by setting flow path resistance of the siphon conduit from the discharge water trap conduit to the temporary reservoir tank to be higher than flow path resistance of the discharge water trap conduit.

27. The flush toilet device according to claim 26, wherein the discharge water trap conduit includes an inlet portion which is connected to a lower side of the bowl, a rising conduit which is formed so as to extend upward from the inlet portion, and a lowering conduit which is formed so as to extend downward form an end of the rising conduit, and wherein a lower end of a cross section of a flow path at a top portion of the siphon conduit is formed at a higher position than a lower end of a cross section of a flow path at a top portion of the rising conduit.

28. The flush toilet device according to claim 27, wherein in the siphon conduit, a bent portion is formed by a first siphon part and a second siphon part with the top portion interposed therebetween.

* * * * *